United States Patent [19]

Ciurca, Jr. et al.

[11] 4,123,273

[45] Oct. 31, 1978

[54] STABLE FREE RADICAL NITROXYL BLEACHING AGENTS FOR PHOTOGRAPHIC PROCESSES

[75] Inventors: Samuel Ciurca, Jr., Rochester; Carl F. Kohrt, Pittsford,both of N.Y.

[73] Assignee: Eastman Kodak Company, Rochester, N.Y.

[21] Appl. No.: 814,620

[22] Filed: Jul. 11, 1977

[51] Int. Cl.[2] ..... G03C 1/02; G03C 5/30

[52] U.S. Cl. ..... 96/66 T; 96/76 R; 96/114.1

[58] Field of Search ..... 96/114.1, 76, 67, 66 T

[56] References Cited

U.S. PATENT DOCUMENTS 3,615,494 10/1971 Watanabe et al. ..... 96/53

*Primary Examiner*—Mary F. Kelley

*Attorney, Agent, or Firm*—Arthur H. Rosenstein

[57] ABSTRACT

Disclosed herein are aqueous and nonaqueous photographic bleaching solutions and photothermographic elements comprising stable free radical nitroxyl bleaching agents. These agents are capable of bleaching preformed of developed metals, such as silver, in both aqueous and nonaqueous photographic materials. They do not adversely affect the photographic properties of radiation sensitive emulsions and can be thermally activated in a dry photothermographic process.

20 Claims, No Drawings

STABLE FREE RADICAL NITROXYL BLEACHING AGENTS FOR PHOTOGRAPHIC PROCESSES

BACKGROUND OF THE INVENTION

1. Field of the Invention

The present invention relates to novel compositions and methods for bleaching metals in photographic materials. More particularly, the present invention relates to novel bleaching agents and their use in aqueous and nonaqueous photographic materials. One of its aspects relates to novel bleaching solutions which are capable of bleaching preformed or developed silver in aqueous and nonaqueous photographic materials. Another of its aspects relates to novel bleaching agents for incorporation into radiation sensitive elements, particularly photothermographic elements, for converting metallic image silver in said elements to a colorless, innocuous product.

2. Description of the Prior Art

In the processing of photographic silver halide color elements and in some black-and-white photographic processes, it is necessary to remove metallic silver formed during development. This is ordinarily accomplished by the use of a silver bleaching composition which converts metallic silver into a soluble silver salt. A bleach commonly used for this purpose is an aqueous solution of a water-soluble ferricyanide, such as sodium or potassium ferricyanide, and an alkali metal bromide. Aqueous bleaching solutions comprising aromatic nitroso bleaching agents are described in U.S. Pat. Nos. 2,625,477 (Sawdey), issued Jan. 13, 1953 and 2,705,201 (Tulagin), issued Mar. 29, 1955. U.S. Pat. No. 3,707,374 (Van Der Voorn et al), issued Dec. 26, 1972, relates to aqueous bleaching solutions comprising water-soluble persulfate salts or water-soluble nitrosodisulfonate salts and aromatic amines.

Combined bleaching and fixing compositions for use in photography, commonly referred to as bleach-fix compositions have been known for many years. They are used in processing silver halide photographic materials to simultaneously accomplish the steps of bleaching and fixing and thereby eliminate one step in the conventional processing procedure. The essential components of a bleach-fix composition are the bleaching agent, i.e. an agent which oxidizes the metallic silver in the silver image to a soluble form, and the fixing agent, i.e., an agent which dissolves the undeveloped silver halide and the silver salts formed by the action of the bleaching agent. U.S. Pat. No. 3,189,452 (Bard et al), issued June 15, 1965, describes aqueous bleach-fix compositions prepared by combining conventional bleaching agents such as alkali metal dichromates and alkali metal ferricyanides with conventional fixing agents such as alkali metal thiocyanates. Other known aqueous bleach-fix solutions include those described in U.S. Pat. No. 3,615,508 (Stephen et al), issued Oct. 26, 1971; U.S. Pat. No. 3,634,088 (Cooley), issued Jan. 11, 1972, wherein the solutions comprise a ferric salt of an aminopolycarboxylic acid as a bleaching agent and a thiosulfate as a fixing agent; U.S. Pat. No. 3,706,561 (Mowrey et al), issued Dec. 19, 1972, wherein ferric ion-ligand complexes are used as bleaching agents and thiosulfates, thiocyanates, thioethers, or thioureas are used as fixing agents; and U.S. Patent application Ser. No. 389,063 (Barton et al), filed Aug. 16, 1973 now U.S. Pat. No. 4,033,771.

U.S. Pat. Nos. 3,600,168 and 3,600,169 (Lawton), both issued Aug. 17, 1971 disclose the use of stable free radicals, such as nitroxyls, in compositions for electrostatic light sensitive reproduction sheets. *Chemical Abstracts,* Vol. 64, 1966, Abstract 198876 discloses the use of free radical nitroxyl compounds as antioxidants and ultraviolet light absorbers in polymeric materials. U.S. Pat. No. 3,322,542 (Ullman et al), issued May 30, 1967, teaches the use of nitroxides to stabilize polychromic compounds against molecular deterioration.

British Pat. No. 1,326,889 (Konishiroku), published Aug. 15, 1973 teaches the use of nitroxyl radicals as antifading agents in conventional color photographic materials. Konishiroku, however, does not teach or suggest the use of stable free radical nitroxyl compounds as bleaching agents in bleaching solutions and radiation sensitive elements, particularly photothermographic elements.

Copending U.S. application Ser. No. 367,304, filed June 5, 1973 by Chang et al now abandoned teaches the use of nitroxyl radicals as selective oxidizing agents in photographic elements such as color diffusion transfer elements.

It is well known to develop a latent image in a photothermographic element using thermal processing. After imagewise exposure, the resulting latent image in the photothermographic element is developed and, in some cases, stabilized, merely by uniformly heating the photothermographic element. Such materials and process are described, for example, in U.S. Pat. Nos. 3,152,904 (Sorensen et al), issued Oct. 13, 1964, 3,301,678 (Humphlett et al), issued Jan. 31, 1967; 3,392,020 (Yutzy et al), issued July 9, 1968; 3,457,075 (Morgan et al), issued July 22, 1969; British Pat. No. 1,131,108 published Oct. 23, 1968; German Pat. No. 888,045 issued June 29, 1943 and British Pat. No. 1,161,777 published Aug. 20, 1969. Certain photothermographic materials for producing an image in color are also known as described, for example, in U.S. Pat. No. 3,531,286 (Renfrew), issued Sept. 29, 1970 and U.S. Pat. No. 3,761,270 (deMauriac et al), issued Sept. 25, 1973.

U.S. Pat. No. 4,021,240 of Cerguone et al, issued May 3, 1977, relates to photothermographic and thermographic elements, compositions and processes for providing a developed image in color. There is no teaching or suggestion in this application of the present invention.

Copending U.S. application Ser. No. 662,403 of Mowrey and Oftedahl, filed Mar. 1, 1976, now abandoned relates to an activator sheet for a dry thermal silver dye bleach process. The sheet comprises a support, a diffusible mineral or organic acid and a nonhydrolyzable polymeric vehicle. This application does not teach or suggest the present invention. There is no prior art which teaches or suggests the present invention. This invention provides novel and unobvious bleaching solutions and radiation sensitive elements, particularly photothermographic elements, comprising stable free radical nitroxyl bleaching agents. These bleaching agents provide the following advantages over bleaching agents in the prior art:

1. they may be incorporated in photographic elements without adversely affecting the photographic properties of radiation sensitive emulsions, some of which may be thermally activated;

2. they are capable of bleaching preformed or developed silver in both aqueous and nonaqueous photographic materials;
3. they are effective in converting metallic image silver to a colorless, innocuous product by a dry thermal process;
4. they are biodegradable and easily destroyed by ozonolysis, lessening environmental pollution;
5. their oxidation potential and, hence, their bleaching characteristics can be controlled by the hydrogen ion concentration when they are used in bleaching solutions; and
6. they are capable of acting as both a bleaching agent and a fixing agent when they comprise certain substituents.

Nonaqueous photographic materials useful in the practice of the present invention include those in which a radiation sensitive element is contained in a water-insoluble or a water-impermeable binder. Exemplary of these materials are photothermographic elements adapted for thermal development which contain poly(vinyl butyral) or other suitable binders.

Aqueous photographic materials include those in which a radiation sensitive element is contained in a water-soluble or a water-permeable binder, such as hydrophilic proteinaceous colloids like gelatin. Exemplary of these materials are conventional silver halide photographic elements.

SUMMARY OF THE INVENTION

One aspect of the present invention comprises a photographic bleaching solution having an effective hydrogen ion concentration greater than about $10^{-7}$ comprising a stable free radical nitroxyl bleaching agent.

Another aspect comprises a photographic bleaching solution having an effective hydrogen ion concentration greater than about $10^{-7}$ comprising a silver (I) ion complexing agent wherein the Ksp of the complexed product of silver (I) ion and the complexing agent is less than about $10^{-12}$ at 25° C., and a stable free radical nitroxyl bleaching agent.

In another aspect of the present invention, a radiation sensitive element comprises a support, having thereon a radiation sensitive layer and in the same or a different layer, a stable free radical nitroxyl bleaching agent.

In a further aspect of the present invention, a photothermographic element comprises a support having thereon a layer comprising a reducing agent, a silver salt oxidizing agent and a silver halide; and, in the same or a different layer, a stable free radical nitroxyl bleaching agent.

In still another aspect of the present invention, a photothermograhic element comprises a support having thereon a layer comprising a reducing agent, a silver salt oxidizing agent and a silver halide; and, another layer comprising a silver (I) ion complexing agent wherein the Ksp of the complexed product of silver (I) ion and the complexing agent is less than about $10^{-12}$ at 25° C.; and in the same or different layer, a stable free radical nitroxyl bleaching agent.

In a further aspect of the present invention, a process for bleaching a metal having a standard electrode potential at 25° C. of 0.799 or less in a radiation sensitive element comprising a support having thereon a radiation sensitive layer comprising a metal having a standard electrode potential at 25° C. of 0.799 or less comprises immersing the element in a photographic bleaching solution having an effective pH less than about 7.0 comprising a free radical nitroxyl bleaching agent.

Still another aspect of the present invention comprises a process for producing a photographic image comprising the steps of:

1. exposure of a photothermographic element to light, said element comprising a support having thereon a layer comprising a reducing agent, a silver salt oxidizing agent and a silver halide; and
2. thermal development at a temperature above about 80° C., an improvement of which process comprises the incorporation into the photothermographic element, a free radical nitroxyl bleaching agent.

DESCRIPTION OF THE PREFERRED EMBODIMENTS

The preferred stable free radical nitroxyl bleaching agents useful in the bleaching solutions and radiation sensitive elements, particularly photothermographic elements of the present invention have a formula selected from the group consisting of:

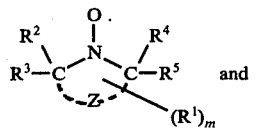

I.

and

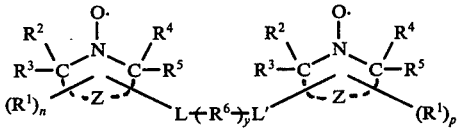

II.

wherein Z comprises the nonmetallic atoms necessary to complete a 5 to 7 member heterocyclic ring; y is 0 or 1; m, n and p are independently selected from the group of integers of 1 to 4.

$R^1$ is independently selected from the group consisting of hydrogen; alkyl, preferably having from 1 to 6 carbon atoms, such as methyl, ethyl, propyl, butyl, pentyl, hexyl and isomers thereof; substituted alkyl, including haloalkyls, such as chloromethyl, dichloromethyl, bromomethyl and the like, aralkyl, such as benzyl, and other substituted alkyls known to those skilled in the art; amino, such as represented by the formula

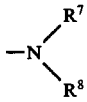

wherein $R^7$ and $R^8$ are independently selected from the group consisting of hydrogen, alkyl, as described above, cycloalkyl, aryl and a 5 to 10 member nonmetallic heterocyclic ring, all of which are described below; substituted or unsubstituted cycloalkyl having from 4 to 10 carbon atoms, including cyclobutane, cyclopentane, cyclohexane, cycloheptane, chlorocyclohexane, 1,2-dichlorocyclohexane and the like; hydroxy; hydroxyimino (=NOH); imino isothiocyanato (—N=C=S); oxo (=O); a 5 to 10 member nonmetallic heterocyclic ring, as described below; a complexing ligand for silver (I) ion wherein the Ksp of the complexed product of the ligand and silver (I) ion is less than about $10^{-12}$ at 25° C. such as thioureas, thiocyanate, isothiouroniums and the like; and —L—$R^9$, wherein $R^9$ is selected from the group consisting of hydrogen; alkyl, preferably having from 1 to 20 carbon atoms, such as methyl, ethyl, propyl, and the like, and isomers thereof, including alkyl substituted with one or more of such groups as hydroxy, halogen, carboxy, substituted or unsubstituted aryl, preferably having from 6 to 12 carbon atoms, as described below, a 5 to 10 member heterocyclic, such as pyrrole, pyrazole, triazole, imidazole, pyrrolidine, oxazine, dioxazole, oxathiazole, piperidine, isoxazine, azepine, dithiane, isoindole, indole, and the like, alkoxy preferably having from 1 to 20 carbon atoms, such as methoxy, ethoxy, propoxy, and the like, aryloxy, preferably having from 6 to 12 carbon atoms, and other substituents known to those skilled in the art. $R^9$ can also be substituted or unsubstituted aryl, preferably having from 6 to 12 carbon atoms, such as phenyl, naphthyl, tolyl, benzyl, xylyl and the like, or phenyl having one or more substituents such as alkoxy, alkyl, halogen, carboxy, amino, as described above, nitro, sulfonic acid or salt thereof such as $-SO_3X$ wherein X is a monovalent cation such as an alkali metal, $NH_4^+$, etc., carbonamide $$(-\overset{O}{\overset{\|}{C}}NH_2)$$

and the like; haloalkyl preferably having from 1 to 6 carbon atoms, such as chloromethyl, dichloromethyl, trichloromethyl, bromomethyl, trifluoromethyl, chloroethyl, 1-chloropropyl, and the like and isomers thereof; substituted or unsubstituted alkenyl, preferably having from 2 to 6 carbon atoms, such as ethenyl, propenyl, butenyl, pentenyl, hexenyl and isomers thereof; hydroxy; amino, as described above; cation of a quaternary ammonium salt, including quaternary aliphatic groups, such as

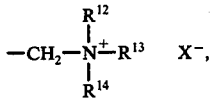

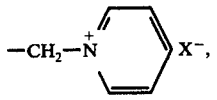

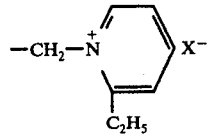

and the like wherein $R^{12}$, $R^{13}$ and $R^{14}$ are independently selected from the group consisting of substituted or unsubstituted alkyl, and aryl, preferably having from 6 to 12 carbon atoms as described above, and X is an anion, such as a halide, including chloride and bromide, chlorite, chlorate, and the like. $R^9$ can additionally be a 5 to 10 member nonmetallic heterocyclic ring, as described below.

L and L' are the same or different and are linking groups selected from the group consisting of amino ($-NR^{10}-$);

carbonamido ($-NR^{10}\overset{O}{\overset{\|}{C}}-$); ureylene ($-NR^{10}\overset{O}{\overset{\|}{C}}NR^{11}-$);

thioureylene ($-NR^{10}\overset{S}{\overset{\|}{C}}NR^{11}-$);

oxymethylene carbonamido ($-NR^{10}\overset{O}{\overset{\|}{C}}CHR^{11}O-$);

carbonyloxy ($-\overset{O}{\overset{\|}{C}}O-$); carbonyldioxy ($-O\overset{O}{\overset{\|}{C}}O-$);

oxycarbonyl ($-O\overset{O}{\overset{\|}{C}}-$); carbonyl ($-\overset{O}{\overset{\|}{C}}-$);

sulfonamido ($-NR^{10}SO_2-$); amidothiocarbonyl ($-NR^{11}\overset{S}{\overset{\|}{C}}-$);

oxymethylene oxycarbonyl ($-O\overset{O}{\overset{\|}{C}}-CHR^{10}O-$); and dicarbonamido ($-NR^{10}\overset{O}{\overset{\|}{C}}NR^{11}\overset{O}{\overset{\|}{C}}-$).

$R^{10}$ and $R^{11}$ are the same or different and are selected from the group consisting of $R^1$, $R^7$ and $R^8$.

$R^2$, $R^3$, $R^4$ and $R^5$ are independently selected from the groups consisting of substituted or unsubstituted alkyl, preferably having from 1 to 6 carbon atoms, cycloalkyl, aralkyl, aryl; or $R^2$ and $R^3$ or $R^4$ and $R^5$ can be taken together with the carbon atom of the ring to which they are attached to form a cycloalkyl or cycloalkenyl having from 4 to 10 carbon atoms.

$R^6$ is selected from the group consisting of substituted or unsubstituted alkylene, preferably having from 1 to 12 carbon atoms, such as methylene, ethylene, propylene, butylene, pentylene, hexylene, chloromethylene, and the like and isomers thereof; substituted or unsubstituted cycloalkylene, preferably having from 5 to 10 carbon atoms, such as cyclopentylene, cyclohexylene, chlorocyclohexylene and the like; substituted or unsubstituted arylene, preferably having from 6 to 16 carbon atoms, such as phenylene, tolylene, phenylenedimethylene, naphthylene, and the like; a 5 to 7 member substituted or unsubstituted bivalent nitrogen-containing heterocycle, such as

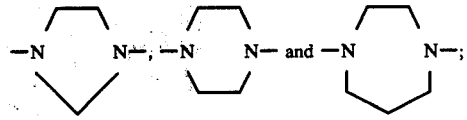

and a thio-interrupted alkylene chain, such as $-(CH_2)_m-S-(CH_2)_n-S-(CH_2)_p-$ wherein m, n and p are as defined above, and when the bleach is a salt can be heterocyclic alkylene such as

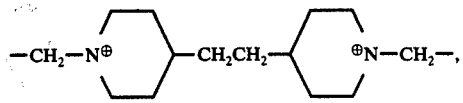

-continued

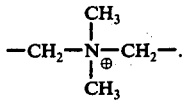

It is noted that both $R^1$ and $R^6$ can be a variety of moieties and that salt formed of the nitroxyl compounds are also useful herein.

In all aspects of the present invention, the 5 to 10 member heterocyclic rings, including those 5 to 7 member rings completed by Z, comprise nonmetallic atoms, such as C, N, O, S, and the like. Exemplary of such rings are pyrrole, pyrazole, triazole, imidazole, pyrrolidine, oxazine, dioxazole, oxathiazole, piperidine, isoxazine, azepine, indole, isoindole, and the like. The heterocyclic ring may be saturated or unsaturated.

Complexing ligands for silver (I) ion wherein the Ksp of the complexed product of the ligand and silver (I) ion is less than about $10^{-12}$ at 25° C. include thiosulfate, thiourea, thiocyanate, thioanamide, imidazolidine thiones, imidozoline thiones and the like.

In a more preferred embodiment of the present invention, a photographic bleaching solution having an effective hydrogen ion concentration greater than about $10^{-7}$ comprises a nitroxyl bleaching agent having the formula

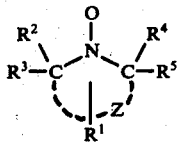

wherein $R^2$, $R^3$, $R^4$ and $R^5$ are as described above and Z comprises the nonmetallic atoms necessary to complete a 5 or 6 member substituted or unsubstituted heterocyclic ring, such as piperidine, isoxazine, pyrrolidine, pyrroline and the like; and $R^1$ is selected from the group consisting of alkyl, amino, cycloalkyl, hydroxyimino, imino, isothiocyanato, oxo, a 5 to 10 member nonmetallic heterocyclic ring, and a complexing ligand for silver (I) ion, all of which are described above. Other substituents on the 5 or 6 member heterocyclic ring may include alkyl, cycloalkyl, aryl, amino and heterocyclic rings, as described above.

Nitroxyl bleaching agents which are particularly useful in the practice of this invention include the following compounds:

Compound 1

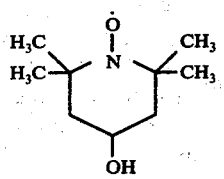

Compound 2

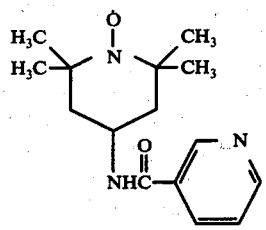

Compound 3

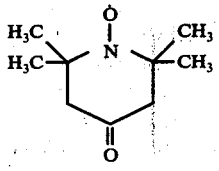

Compound 4

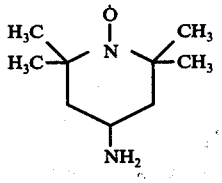

Compound 5

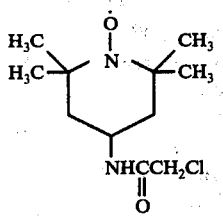

-continued
Compound 6
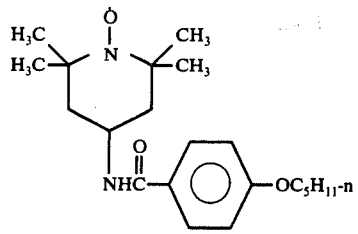
Compound 7
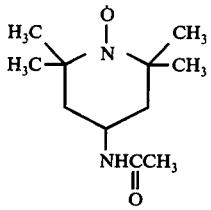
Compound 8
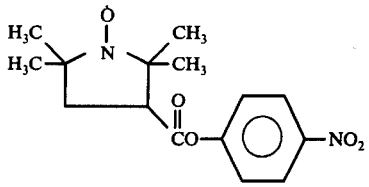
Compound 9
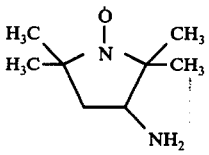
Compound 10
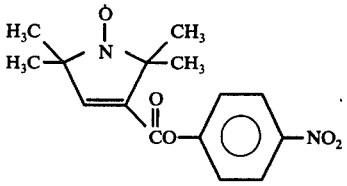
Compound 11
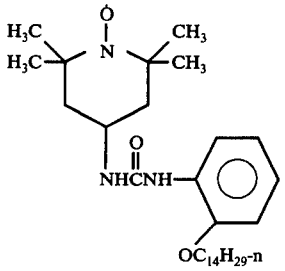
Compound 12
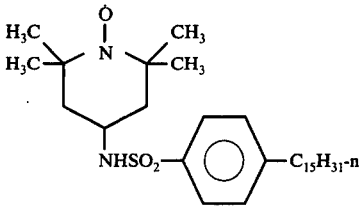

-continued
Compound 13
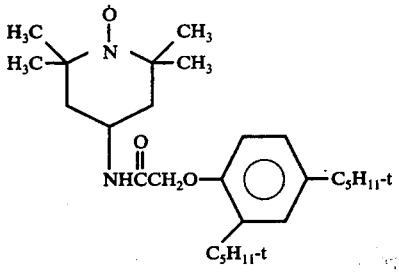
Compound 14
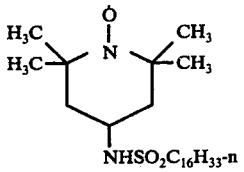
Compound 15
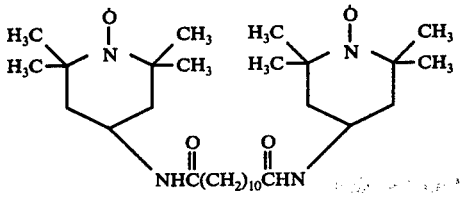
Compound 16
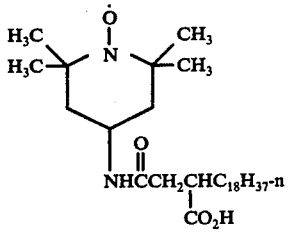
Compound 17
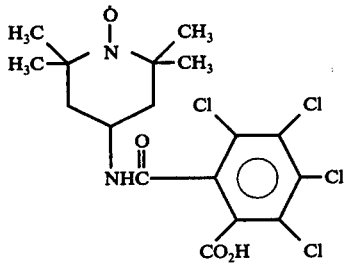
Compound 18
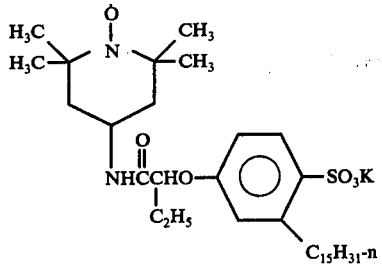

-continued
Compound 19
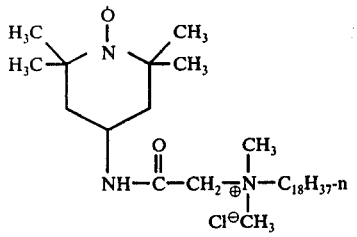
Compound 20
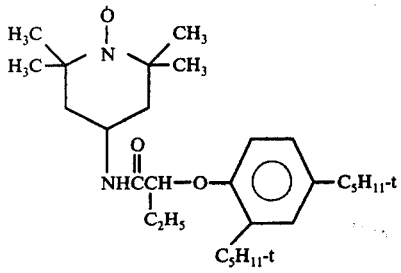
Compound 21
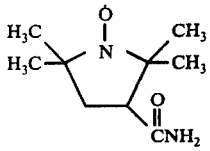
Compound 22
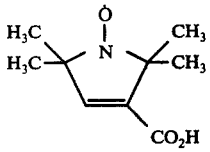
Compound 23
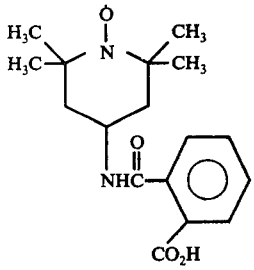
Compound 24
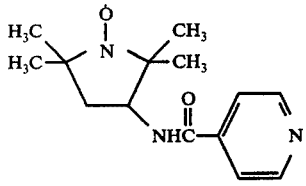
Compound 25
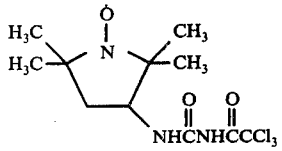
Compound 26
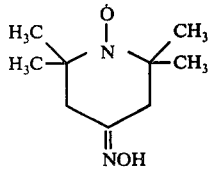

-continued
Compound 27
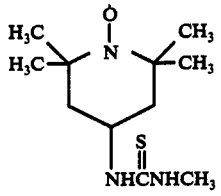
Compound 28
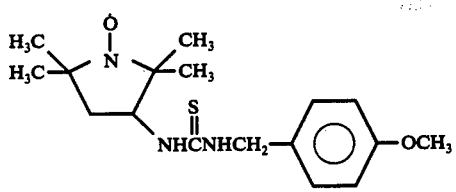
Compound 29
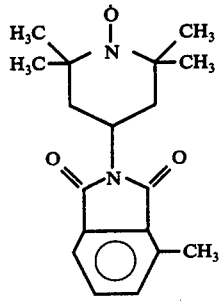
Compound 30
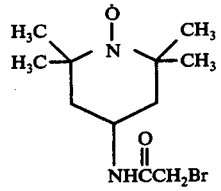
Compound 31
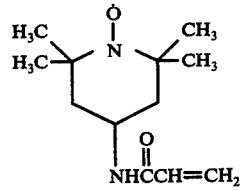
Compound 32
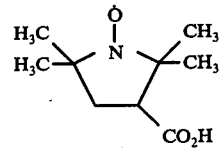
Compound 33
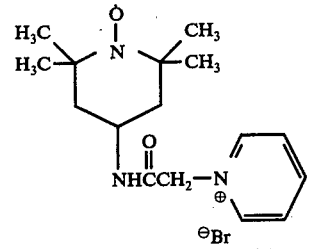

-continued
Compound 34
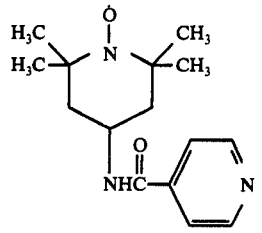
Compound 35
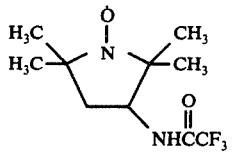
Compound 36
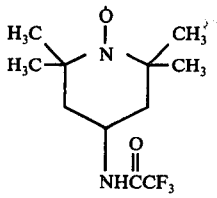
Compound 37
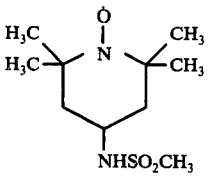
Compound 38
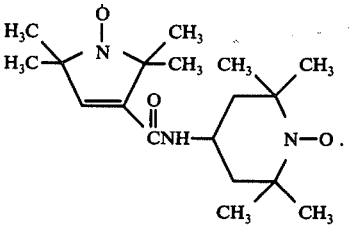
Compound 39
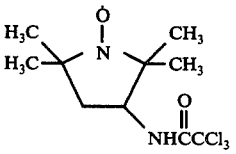
Compound 40
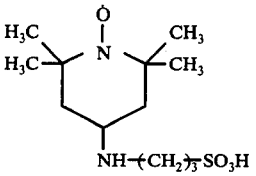
Compound 41
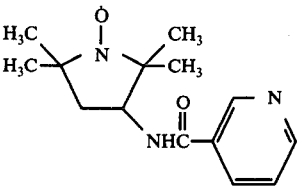

-continued
Compound 42
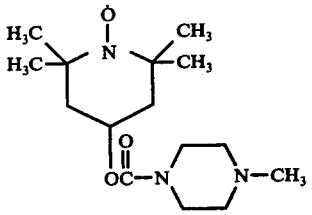
Compound 43
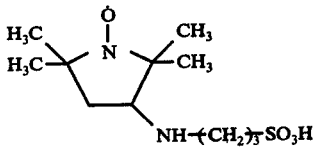
Compound 44
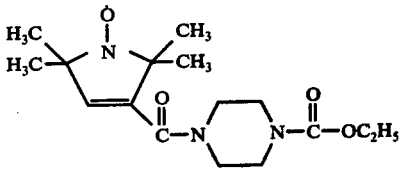
Compound 45
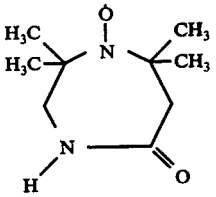
Compound 46
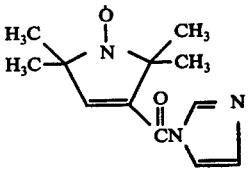
Compound 47
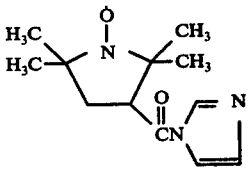
Compound 48
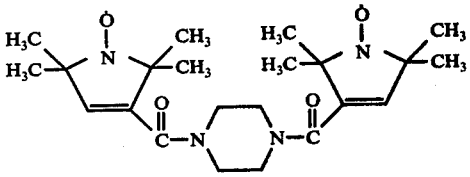
Compound 49
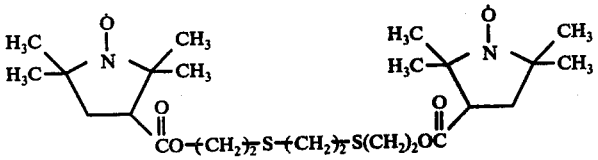

-continued
Compound 50
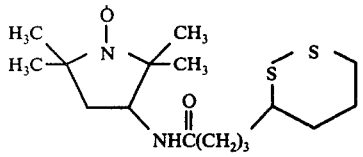
Compound 51
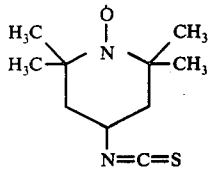
Compound 52
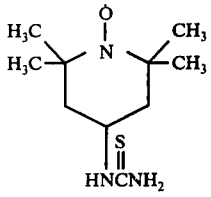
Compound 53
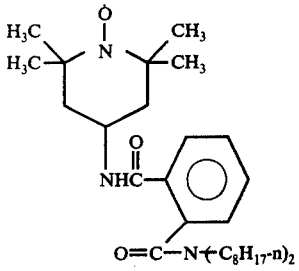
Compound 54
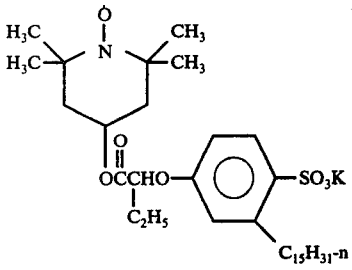
Compound 55
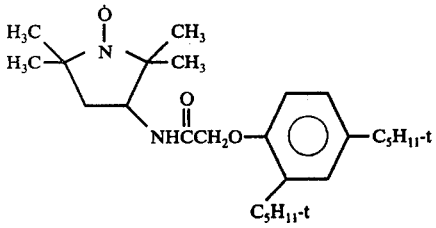
Compound 56
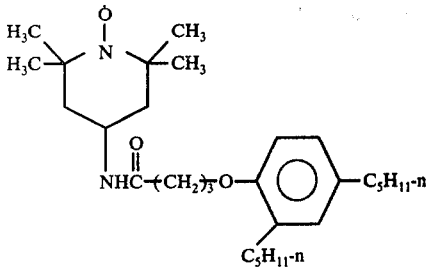

-continued
Compound 57
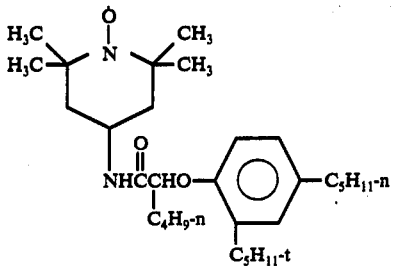
Compound 58
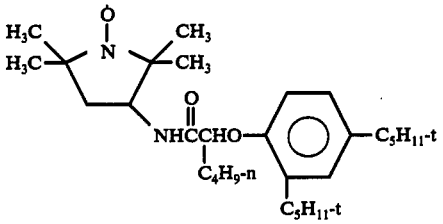
Compound 59
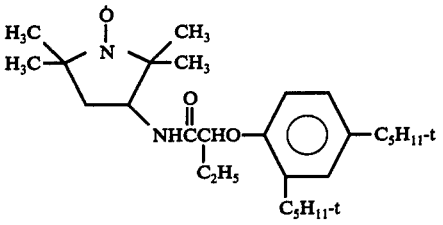
Compound 60
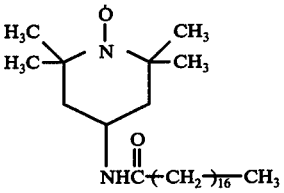
Compound 61
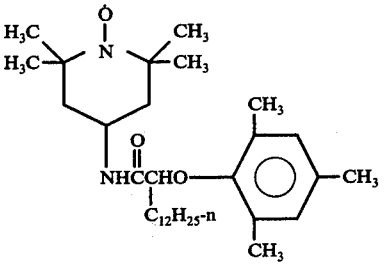
Compound 62
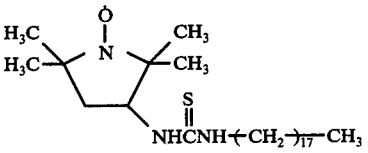
Compound 63
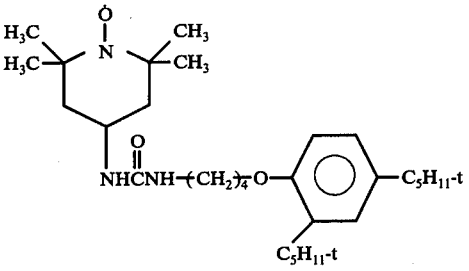

-continued
Compound 64
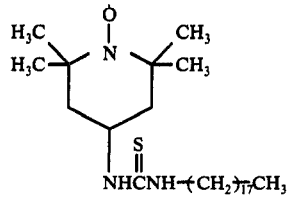
Compound 65
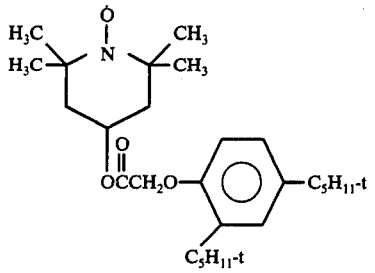
Compound 66
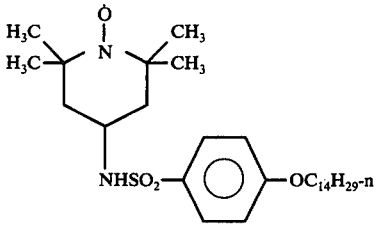
Compound 67
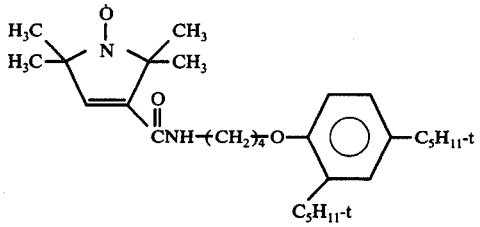
Compound 68
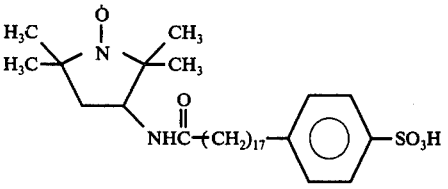
Compound 69
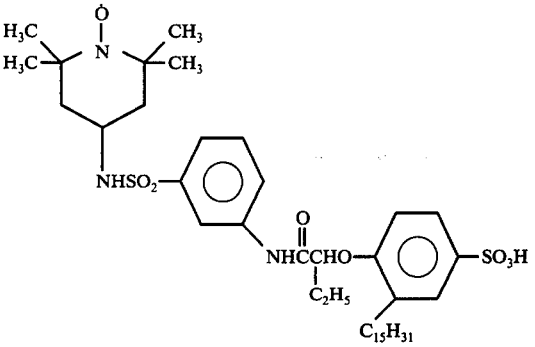

-continued
Compound 70
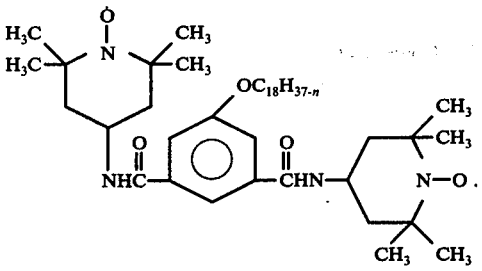
Compound 71
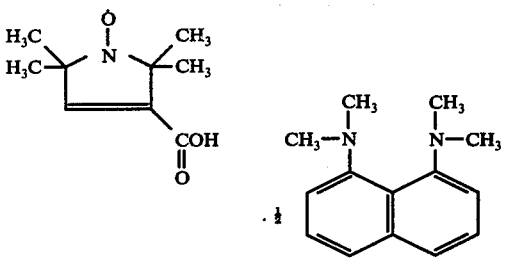
Compound 72
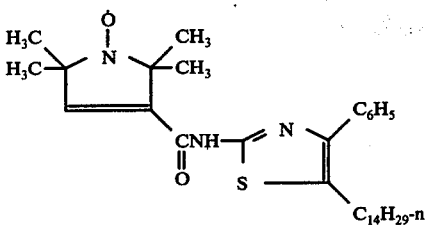
Compound 73
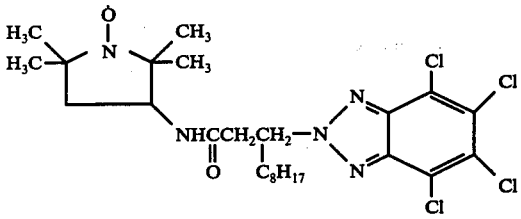
Compound 74
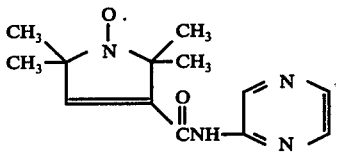
Compound 75
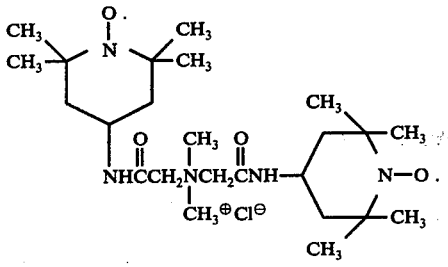
Compound 76
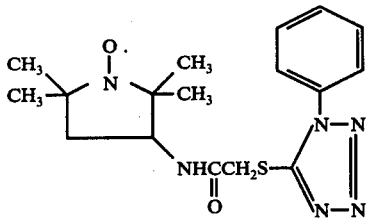

-continued

Compound 77

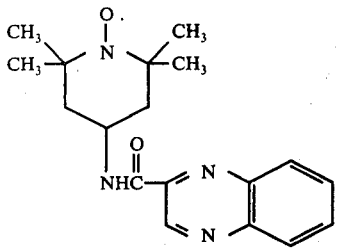

Compound 78

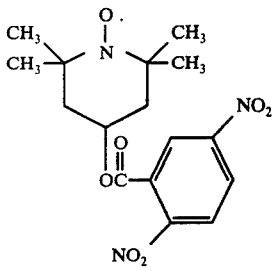

Compound 79

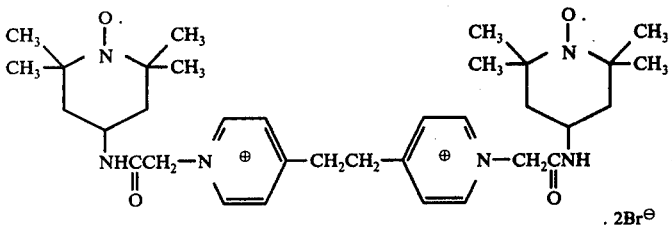

Compound 80

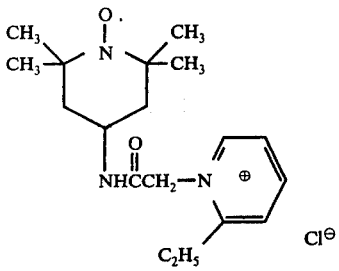

Compound 1 is the most preferred nitroxyl bleaching agent in the materials of the present invention.

Many free radical nitroxyl bleaching agents useful in the present invention are available commercially such as Compound 1, Compound 3 and Compound 32. In general, the nitroxyl bleaching agents can be prepared by procedures disclosed by E. G. Rozanstev, *Free Nitroxyl Radicals,* Plenum Press, 1970, hereby incorporated by reference. The preparative methods included below illustrate how these nitroxyl compounds can be prepared. Other preparative methods are known to those of ordinary skill in the art.

The concentration range of the nitroxyl bleaching agents useful in the bleaching solutions of the present invention is from about 0.01 M up to the saturated amount limited by the solubility of the particular nitroxyl in the particular solvent, but preferably from about 0.05 M to about 0.25 M. One mole of a nitroxyl bleaching agent in solution is capable of bleaching up to about 1 mole of silver.

The nitroxyl bleaching agents which are most useful in the aqueous bleaching solutions of the present invention include Compound 1, Compound 4, and Compound 32. The nonaqueous bleaching solutions of the present invention comprise an organic solvent such as methanol, ethanol, toluene, N,N-dimethyl formamide, ligroin etc., and preferably methanol. The nitroxyl bleaching agents which are most useful in nonaqueous bleaching solutions of the present invention include Compound 1, Compound 5 and Compound 22. Both aqueous and nonaqueous bleaching solutions of the present invention tend to be colorless or only slightly colored and leave no stain on bleached elements.

The bleaching solutions described herein are preferably used at any "effective" hydrogen ion concentration greater than about $10^{-7}$. By "effective" is meant hydrogen ion concentration (HIC) determined in both nonaqueous and aqueous solutions with Pt electrodes at 23° C. by measuring with a commercial pH meter (Corning) vs. a standard calomel electrode. The most useful HIC ranges of the bleaching solutions comprising particular nitroxyl bleaching agents depend upon the presence or absence of a bleach accelerator or catalyst. In the absence of a catalyst, the most useful HIC range of an aqueous solution may be $10^{-4}$ or more at 25° C. With a catalyst present, aqueous bleaching solutions are most useful at any HIC greater than about $10^{-7}$ at 25° C. For the nonqueous bleaching solutions of the present invention, the preferred effective HIC range is about $10^{-1}$ to about $10^{-4}$ without a catalyst and more than about $10^{-7}$ with a catalyst.

Bleach accelerators or catalysts useful in the practice of this invention include aminophenols, such as

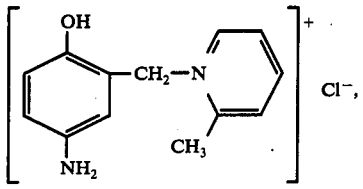

p-aminophenol, p-methylaminophenol, p-dimethylaminophenol, 2,4-diaminophenol and the like; phenylenediamines, such as p-phenylenediamine, N-methyl-p-phenylenediamine, N,N'-dimethyl-p-phenylenediamine, 2-methyl-4-diethylamino-aniline, and the like as disclosed in U.S. Pat. No. 3,707,374 (Van Der Voorn et al), issued Dec. 26, 1972; thioureas; and mercaptothiadiazoles. Other useful catalysts include compounds which are capable of forming reactive free radical intermediates, such as semiquinones including N,N,N',N'-tetramethyl-p-phenylenediamine. Electron transfer agents known to be useful as catalysts in silver dye bleach processes, such as phenazine derivatives including phenazine, hydroxyaminophenazine and the like and thiazine derivatives including quinoxaline and the like can also be useful in the bleaching solutions of the present invention. Strong electron acceptors, such as 2,3-dicyano-5,6-dichlorobenzoquinone and tetracyanoethylene, are also useful.

The amount of a catalyst useful in the bleaching solutions of the present invention depends upon such circumstances as the type of catalyst and bleaching agent employed, the pH, the solvent, the hydrophobic and hydrophilic nature of a radiation sensitive element to be bleached, the amount of silver to be removed, etc. The concentration range is normally from zero up to the molar amount of nitroxyl bleaching agent used, and preferably about 0.005 M.

As noted hereinabove, the bleaching solutions of the present invention may comprise a silver (I) ion complexing agent wherein the Ksp of the complexed product of silver (I) ion and the complexing agent is less than about $10^{-12}$ at 25° C. Suitable complexing agents for non-aqueous bleaching solutions include such compounds as

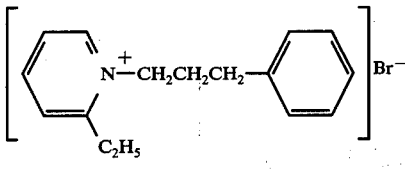

and other onium halides; and thiourea, isothiocyanate and ammonium thiosulfate for aqueous solutions. These complexing agents are advantageously incorporated in the bleaching solutions when the nitroxyl bleaching agent may have adverse sensitometric effects on the radiation sensitive properties of radiation sensitive elements to be bleached.

In addition to the nitroxyl bleaching agent, other addenda commonly utilized in photographic bleaching solutions can be incorporated in the bleaching solutions of this invention. For example, the solutions can advantageously contain alkali metal halides or ammonium halides, such as sodium bromide, potassium bromide, ammonium bromide, sodium chloride, potassium chloride, ammonium chloride; mercaptotriazoles; and thiocyanates which function to aid in the bleaching; nonchelated salts of aminocarboxylic acids which function as sequestering agents, such as sodium salts of ethylenediaminetetraacetic acid; hardeners, such as aldehydes; bis(vinyl sulfonylmethylether) and the like. It can be advantageous to also incorporate a buffer in the bleaching solution to provide proper pH control. For this purpose, any of the buffers commonly used in photographic processing solutions may be employed, e.g., phosphoric acid, hydrochloric acid, alkali metal phosphates, acetic acid, alkali metal acetates, maleic acid, alkali metal maleates, alkali metal borates, etc., and preferably those buffers having anions capable of forming sparingly soluble salts with silver (I) ion.

The nitroxyl bleaching agents described herein may be useful in combination with one or more other bleaching agents including other nitroxyl compounds; conventional inorganic bleaching agents such as potassium ferricyanide, ferric chloride and the like; and organic oxidants such as ammonium persulfate, 2,5-dinitrobenzenesulfonic acid and the like.

The bleaching solutions of the present invention can be used as bleach-fix solutions whereby bleaching and fixing of a radiation sensitive element are accomplished in one step of processing. Nitroxyl bleaching agents described herein which also act as fixing agents include Compounds 27, 28, 33, 51 and 52. Other nitroxyl compounds described herein may be used with conventional fixing agents which include alkali thiocyanates, such as sodium thiocyanate, potassium thiocyanate, and the like; ammonium thiocyanate; alkali metal thiosulfates, such as sodium thiosulfate, potassium thiosulfate, and the like; ammonium thiosulfate; thioureas; alkali metal selenocyanates, such as sodium selenocyanate, potassium selenocyanate and the like; β-diketones: pyridinium salts; and carboxylic acids. The fixing agent is usually present in a concentration range of about 0.05 M to about 0.5 M in the bleach-fix solution. Bleach-fix solutions of the present invention can advantageously comprise sulfurization retardants such as carbonyl bisulfite adducts, including alkali metal bisulfites, alkaline earth metal bisulfites, and amine bisulfites. Exemplary of such adducts are sodium acetaldehyde bisulfite, sodium propionaldehyde bisulfite, succinaldehyde bis-sodium bisulfite, sodium acetone bisulfite, and the like.

The bleaching solutions of the present invention can be used in a process to bleach any metal formed from radiation sensitive elements or otherwise deposited in oxidizable fashion which has a standard electrode potential, as measured at 25° C., of about 0.799 or less. Exemplary of such metals are silver, iron, copper and the like. The bleaching process comprises immersing an element comprising at least one of such metals in a photographic bleaching solution of the present invention and leaving it in said solution for a time of abount 0.5 to about 20 minutes. Aqueous bleaching solutions of the present invention are effective at any conventional processing temperature used in the art. A suitable processing temperature for nonaqueous solutions is dependent on the boiling point of the organic solvent employed and can range up to about 140° C. Bleaching of radiation sensitive elements can be accomplished before or after exposure to actinic radiation and before or after image development.

The bleaching and bleach-fix solutions of the present invention can be used in the processing of radiation sensitive elements designed for black-and-white processing, reversal color processing or in the processing of negative color elements or color print materials. They can be employed with radiation sensitive elements which are processed in color developers containing couplers or with elements which contain the coupler in the silver halide emulsion layers or in layers contiguous thereto.

The nitroxyl bleaching agents useful in the practice of the present invention can also be incorporated into conventional radiation sensitive elements such as in silver halide emulsion layers of photographic elements of various types. These elements can further comprise, in at least one layer different than the silver halide emulsion layers, a silver (I) ion complexing agent wherein the Ksp of the complexed product of silver (I) ion and the complexing agent is less than about $10^{-12}$ at 25° C.

The nitroxyl bleaching agents can be present in the of about 0.1 mole of nitroxyl per mole of silver, and preferably within the range of from about 0.8 to about 2.0 mole of nitroxyl per mole of silver.

The silver (I) ion complexing agents useful in the radiation sensitive elements wherein the Ksp of the complexed product of silver (I) ion and the complexing agent is less than about $10^{-12}$ at 25° C. are the same as those described above as useful in the bleaching solutions of the present invention. The Ksp value in the elements is taken to be same as that measured in solution by techniques known in the art, such as disclosed by J. N. Butler in *Solubility and pH Calculations,* Addison-Wesley Publishing, 1964, hereby incorporated by reference.

Some of the nitroxyl bleaching agents described herein can be mixed with a silver halide emulsion and coated together in the same layer. Such agents, including Compound 2, Compound 6 and Compound 13, do not interfere with either exposure, image development or color-forming reactions, if any. Following processing, the incorporated bleaching agent can be made to selectively bleach the silver image by introducing a suitable complexing agent which has a suitable complexing ligand for silver (I) ion. This complexing agent suppresses the concentration of silver (I) ion, thereby promoting the bleaching of silver metal. Alternatively, other nitroxyl bleaching agents, such as Compound 33, Compound 51 and Compound 52, have complexing ligands attached thereon which would cause desensitization of the silver halide emulsion and hence cannot be incorporated in the emulsion. They may be coated as interlayers or overcoats such that image development is completed before the bleaching agents can diffuse into the image layers, and no additional complexing agent is necessary.

The radiation sensitive elements comprising nitroxyl bleaching agents comprise supports which can be made of a variety of materials including polyethylene terephthalate, cellulose acetate butyrate, polycarbonates, polystyrene, polyolefins (e.g., polyethylene, polypropylene) and the like, metals, glass, paper, polyolefin coated paper such as polyethylene or polypropylene coated paper which can be pigmented, with $TiO_2$, for example, and electron bombarded to promote emulsions adhesion, and other materials known to those having skill in the art.

The silver halide emulsion layers present in the radiation sensitive elements can contain any of the conventional silver halides as the radiation sensitive material, for example, silver chloride, silver bromide, silver bromoiodide, silver chlorobromide, silver chloroiodide, silver chlorobromoiode, silver iodide and mixtures thereof, and other radiation sensitive silver compounds. Each layer typically contains from about $2 \times 10^{-3}$ moles silver halide /m$^2$ to about $2 \times 10^{-2}$ moles silver halide /m$^2$ of support.

These layers can also contain additional additives, particularly those known to be beneficial in photographic emulsions, including for example, stabilizers or antifoggants, particularly the water-soluble inorganic acid salts of cadmium, cobalt, manganese and zinc as disclosed in U.S. Pat. No. 2,829,404, the substituted triazaindolizines as disclosed in U.S. Pat. Nos. 2,444,605 and 2,444,607, speed increasing materials, absorbing dyes, hardeners, plasticizers, and the like. Sensitizers which give particularly good results in the photographic compositions disclosed herein are the alkylene oxide polymers which can be employed alone or in combination with other materials, such as quaternary ammonium salts, as disclosed in U.S. Pat. No. 2,886,437 or with mercury compounds and nitrogen containing compounds, as disclosed in U.S. Pat. No. 2,751,299.

A detailed description of various emulsions in which the nitroxyl bleaching agents can be used can be found in *Product Licensing Index,* publication no. 9232, December, 1971, pp. 107–110, hereby incorporated by reference.

Nitroxyl bleaching agents are particularly useful in radiation sensitive elements which are processed by heat. Such elements such as disclosed in U.S. Pat. No. 3,301,678 (Humphlett et al), issued Jan. 31, 1967 can comprise a silver halide emulsion and a development activator and/or alkali release agent which is different from the developing agent or developing agent precursor or stabilizer precursor, and are heat processed at temperatures from about 90° C. to about 210° C. U.S. Pat. No. 3,669,670 (Haist et al), issued June 13, 1972, discloses similar elements comprising a silver halide emulsion and certain bis-isothiuronium compounds having an intermediate ureylene or ether moiety which provide, upon heating from 90° C. to about 250° C., activation of a developing agent present and/or stabilization of a developed image. S-Carbamoyl silver salt stabilizer precursors useful in heat processable radiation sensitive elements and compositions for image stabilization are disclosed in U.S. Pat. No. 3,824,103 (Pierce et al), issued July 16, 1974.

Some radiation sensitive elements which can comprise nitroxyl bleaching agents are known as silver-dye-bleach elements which contain bleachable dyes, preferably nondiffusible dyes, of the type well known in the art.

Conventional silver halide developers which are useful in photographic elements include hydroquinones, such as hydroquinone, t-butylhydroquinone and the like: catechols; aminophenols, such as p-aminophenol and the like; ascorbic acid and its derivatives; reductone, such as phenidone and the like; phenylenediamines, such as p-phenylenediamine, N-methyl-p-phenylenediamine and the like; and combinations thereof. The developers can be in the silver halide emulsion layer or in another suitable location in the element. They can be added from suitable solvents or in the form of dispersions as described in U.S. Pat. No. 2,592,368 (Yackel), issued Apr. 8, 1952.

Typical hardeners useful in the radiation sensitive elements of the present invention include aldehydes, such as formaldehyde, acetaldehyde and the like; bis(vinyl sulfonyl) compounds; mucochloric acid and the like, aziridine hardeners which are derivatives of dioxane, oxypolysaccharides such as oxystarch, oxy plant gums and the like. Useful concentrations of hardeners are related to the amount of a binder used and are well known in the art.

Binders which are useful in the elements disclosed herein include colloids, such as gelatin, protein derivatives, e.g., carboxymethylated proteins, colloidal albumin, cellulose derivatives, synthetic resins such as polyvinyl compounds, and the like. Typically, a binder comprises from about 3 to about 6 weight percent of the emulsion.

In a preferred embodiment of the present invention, a photothermographic element comprises a support having thereon a layer comprising:

a. a reducing agent;
b. a silver salt oxidizing agent; and
c. a silver halide; and in the same or a different layer, a stable free radical nitroxyl bleaching agent having a formula selected from the group consisting of:

I.

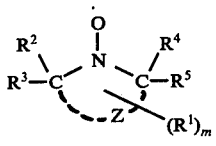

and

II.

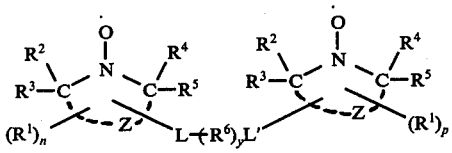

wherein Z, y, m, n, p, $R^1$, $R^2$, $R^3$, $R^4$, $R^5$, $R^6$, L and L' are as defined hereinabove in the description of nitroxyl bleaching agents for photographic bleaching solutions.

These preferred photothermographic elements can further comprise a binder or at least one color-forming coupler.

Particularly preferred are photothermographic elements described hereinabove wherein the nitroxyl bleaching agent has the formula

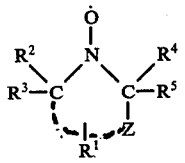

wherein Z comprises the nonmetallic atoms necessary to complete a 5 or 6 member substituted or unsubstituted heterocyclic ring; $R^1$ is selected from the group consisting of alkyl, amino, cycloalkyl, hydroxy, hydroxyimino, imino, isothiocyanato, oxo and a 5 to 10 member nonmetallic heterocyclic ring, all of which substitutes are described hereinabove, and $R^2$, $R^3$, $R^4$ and $R^5$ are methyl groups. The ring may comprise one or more other substituents selected from the group consisting of alkyl, cycloalkyl, aryl, amino and heterocyclic rings, as described hereinabove.

Various reducing agents can be employed in the described photothermographic materials of this invention. These are typically silver halide developing agents and include, for example, polyhydroxybenzenes such as hydroquinone developing agents including, for instance, hydroquinone, alkyl substituted hydroquinones, exemplified by tertiary butyl hydroquinone, methyl hydroquinone, 2,5-dimethyl hydroquinone and 2,6-dimethyl hydroquinone; catechols and pyrogallol; halo-substituted hydroquinones such as chlorohydroquinone or dichlorohydroquinone; alkoxy-substituted hydroquinones such as methoxy hydroquinone or ethoxy hydroquinone and the like. Other reducing agents which can be employed include reductone developing agents such as anhydro dihydro piperidino hexose reductone; hydroxy tetronic acid reducing agents and hydroxy tetronimide developing agents; 3-pyrazolidone developing agents such as 1-phenyl-3-pyrazolidone and 4-methyl-4-hydroxy methyl-1-phenyl-3-pyrazolidone and those described in British Pat. No. 930,572 published July 3, 1963; certain hydroxyl amine developing agents; ascorbic acid developing agents such as ascorbic acid, ascorbic acid ketals, and other ascorbic acid derivatives; phenylene diamine developing agents; certain aminophenol developing agents and the like; bis-β-naphthols, such as 1,1'-bis-β-naphthol, 1,1'-bis-2-naphthol and the like; and sulfonamidophenols, such as 2,6-dichloro-4-benzenesulfonaminophenol and the like. Combinations of reducing agents can also be employed. A suitable reducing agent is one which provides a developed image within about 90 seconds at a temperature of about 100° to 250° C. upon heating the photothermographic element containing the reducing agent.

Color developers which are useful in this invention are those which, in their oxidized form, are capable of reacting with photographic couplers to form dyes or leuco dyes. Typical useful color developers include sulfonamidophenols and sulfonamidoanilines which can be represented by the structure:

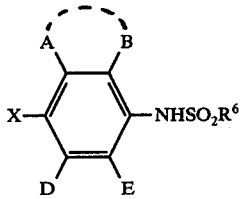

wherein X is —OH or $NR^7R^8$ can be the same or different and are chosen from hydrogen, alkyl, aryl or heteryl; $R^6$ can be substituted or unsubstituted aryl, alkyl or heteryl; A, B, D, and E represent substituted or unsubstituted aryl, alkyl, or heteryl, halogen, cyano, hydrogen and the like; additionally, A and B can be taken together to form a fused carbocyclic or heterocyclic ring.

Examples of such useful color developers are sulfonamidophenols and sulfonamidoanilines which have the structures:

I

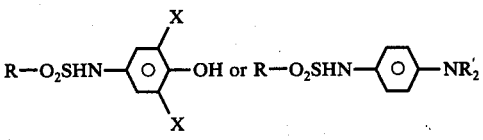

wherein R′ is hydrogen or alkyl such as methyl, X is Cl or Br and R is a group which does not adversely affect the desired sensitometric and dye-forming capabilities of the described photothermographic and thermographic element or composition. Typical non-limiting examples of R include alkyl, alkaryl and aralkyl groups, which can contain from 1 to 35 or more carbon atoms in their "alkyl" portions, dialkylamino groups, preferably having alkyl groups of 1 to 8 carbon atoms, heterocyclic groups, aryl groups and the like. Actually, the particular nature of R in such dibromo or dichloro sulfonamidophenol and sulfonamidoaniline compounds of the structures above is not believed critical with respect to the successful practice of this invention, so long as R is not detrimental, as indicated above.

Typical specific examples of the 2,6-dichloro and 2,6-dibromo compounds that have been found to perform well in photothermographic elements, as described above, include:

A.

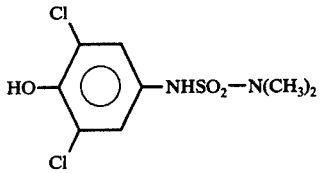

B.

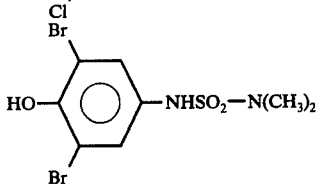

C.

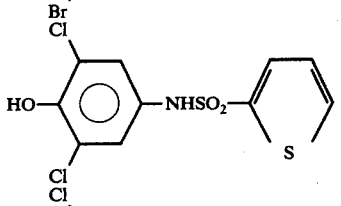

D.

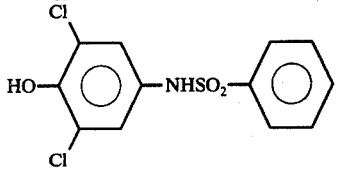

E.

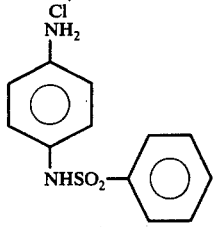

F.

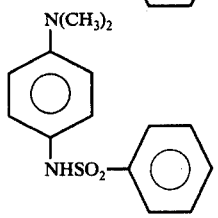

Other reducing agents which are not sulfonamidophenol or sulfonamidoaniline reducing agents and which do not adversely affect the desired color image in the photothermographic material can be used in combination with the other described components of the photothermographic elements and compositions of this invention. Other useful reducing agents include, for example, p-phenylenediamines which can also function as a color developer and bis-beta-naphthol reducing agents as described in U.S. Pat. No. 3,751,249 of Hiller, issued Aug. 7, 1973. Combinations of the described reducing agents can be employed if desired.

Other reducing agents which can be useful with the described 2,6-dichloro and 2,6-dibromo-4-substituted sulfonamidophenol and aniline reducing agents are phenolic (leuco base) dye reducing agents. Useful leuco base dye reducing agents are described in copending U.S. application Ser. No. 488,094 entitled "Photothermographic Element, Composition and Process", filed July 12, 1974.

The phenolic (leuco base) dye reducing agent(s) react(s) with the silver salt oxidizing agent in the photothermographic element of this invention to produce a desired dye in the imagewise exposed areas of the photothermographic element. It is believed that the latent image silver produced upon imagewise exposure catalyzes the reaction between the reducing agent and the silver salt oxidizing agents. In the case of a thermographic material, the color image is provided by imagewise heating. The described reducing agent is believed to be oxidized imagewise to a dye in the exposed or specifically heated areas.

Examples of useful phenolic (leuco base) dye reducing agents according to the invention are as follows:

2-(3,5-di-tert-butyl-4-hydroxyphenyl)-4,5-diphenylimidazole, 2-(4-hydroxy-3,5-dimethoxy)-4,5-bis(p-methoxyphenyl)imidazole, and bis-(3,5-di-tert-butyl-4-hydroxyphenyl)phenylmethane.

Such leuco base dye reducing agents can be prepared by methods known in the art. For example, one method of preparing such reducing agents is described in U.S. Pat. No. 3,297,710 of Silversmith, issued Jan. 10. 1967.

Typical useful concentrations of a reducing agent in the photothermographic elements of the present invention are within the range of from about 0.01 to about 0.10 mole of the described reducing agent per mole of silver ion which corresponds to about 0.1 to about 5.0 millimole of reducing agent per square meter of support.

In a photothermographic element of the invention, the concentration of photosensitive silver halide is typically within the range of from about $0.02 \times 10^{-2}$ to about $1.0 \times 10^{-2}$ moles of silver halide per square meter of support. Examples of useful photographic silver halides are silver chloride, silver bromide, silver bromoiodide, silver chlorobromoiodide, silver iodide or mixtures thereof and others described hereinabove for radiation sensitive elements. The photographic silver halide is typically present with the other components of the described photothermographic elements in the form of an emulsion which is a dispersion of the photographic silver halide in a suitable binder. The photographic silver halide can be coarse or fine-grain, very fine-grain silver halide being especially useful. A composition containing the photographic silver halide can be prepared by any of the well-known procedures in the photographic art, such as single-jet emulsions, Lippmann emulsions, ammoniacal emulsions, thiocyanate or thioether ripened emulsions such as described in U.S. Pat. Nos. 2,222,264 (Nietz et al), issued Nov. 14, 1940; 3,320,069 (Illingsworth), issued May 15, 1967, and 3,271,157 (McBride), issued Sept. 6, 1966. Surface image photographic silver halide emulsions can be used if desired. If desired, mixtures of surface and internal image photographic silver halide emulsions can be used as described in U.S. Pat. No. 2,996,332 (Luckey et al), issued Apr. 15, 1961. Negative type emulsions can be used. The silver halide can be a regular grain silver halide such as described in Klein and Moisar, *Journal of Photographic Science,* Volume 12, No. 5, September–October, 1964, pages 242–251.

The described silver halide can be unwashed or washed to remove soluble salts. In the latter case, the soluble salts can be removed by chill setting and leaching or an emulsion containing the silver halide can be coagulation washed.

The described silver halide can be sensitized with chemical sensitizers such as with reducing agents; sulfur, selenium or tellurium compounds; gold, platinum or palladium compounds; or combinations of these. Suitable procedures for chemical sensitization are described, for example, in U.S. Pat. Nos. 1,623,499 (Shepard), issued Apr. 5, 1927; 2,399,083 (Waller et al), issued Apr. 23, 1946; 3,297,447 (McVeigh), issued Jan. 10, 1967 and 3,297,446 (Dunn), issued Jan. 10, 1967.

Photographic silver halide, as described herein, can be protected against loss of sensitivity during keeping. Useful antifoggants and stabilizers which can be used alone or in combination include, for example, thiazolium salts; azaindene; and mercury salts as described, for example, in U.S. Pat. No. 2,728,663 (Allen et al), issued Dec. 27, 1955; urazoles; sulfocatechols; oximes described, for example, in British Pat. No. 623,448; nitron; nitroindazoles; polyvalent metal salts described, for example, in U.S. Pat. No. 2,839,405 (Jones), issued June 17, 1958; platinum, palladium and gold salts described, for example, in U.S. Pat. No. 2,566,263 (Trivelli et al.), issued Aug. 28, 1951 and U.S. Pat. No. 2,597,915 (Yutzy et al.), issued May 27, 1952.

If desired, the photographic silver halide can be prepared in situ in the photothermographic elements of the present invention. The photographic silver halide can be prepared in a mixture of one or more of the other components of the described photothermographic element rather than prepared separate from the described components and then admixed with them. Such a method is described, for example, in U.S. Pat. No. 3,457,075 (Morgan et al.), issued July 22, 1969. For example, the photographic silver halide can be prepared with a silver salt oxidizing agent such as a silver salt of a fatty acid prior to admixture of the photographic silver halide and silver salt of a fatty acid to other components of the photothermographic materials as described. In this preparation, a halide salt can be added to a suspension of the silver salt of a fatty acid to form a desired photographic silver halide. A useful reaction medium includes water or other solvents which do not interfere with the desired reaction.

The described photothermographic elements can comprise a source of silver (I) ion, which is believed to be an oxidizing agent which reacts with the described reducing agent. This silver salt oxidizing agent should be resistant to darkening under illumination to prevent undesired deterioration of a developed image. Preferably, the silver salt oxidizing agent is a long-chain fatty acid. "Long chain" as employed herein is intended to mean a chain of carbon atoms containing at least 10 carbon atoms, typically 10 to 30 carbon atoms. An especially useful class of silver salt oxidizing agents is the silver salts of long-chain fatty acids containing at least 20 carbon atoms. Compounds which are useful silver salts of long-chain fatty acids are, for example, silver behenate, silver stearate, silver oleate, silver laurate, silver hydroxystearate, silver caprate, silver myristate, silver palmitate and the like.

Other silver salt oxidizing agents which are useful in the present invention include silver benzoate, silver phthalate, silver acetate, silver acid phthalate and the like; silver phthalazinone, silver benzotriazole, silver saccharin and the like; and silver salts of thione compounds, such as those described in U.S. Pat. No. 3,785,830 (Sullivan et al), issued Jan. 15, 1974, including 3-(2-carboxyethyl)-4-methyl-4-thiazoline-2-thione; 3-(2-carboxyethyl)benzothiazoline-2-thione; 3-(2-carboxyethyl)-5-phenyl-1,3,4-oxadiazoline-2-thione, and the like. Combinations of silver salt oxidizing agents can be used if desired.

In the photothermographic elements of the present invention, the concentration of silver salt oxidizing agent is typically within the range of from about 0.1 to about 100 moles per mole of silver halide, or from about $2 \times 10^{-5}$ to about $2 \times 10^{-2}$ moles of silver salt of a fatty acid per square meter of support.

Minor proportions of oxidizing agents which are not silver salts can be used with the silver salts, if desired, such as zinc oxide, gold stearate, mercury behenate, gold behenate and the like.

It is typically useful to have a long-chain fatty acid present in the described photothermographic material to provide a desired image. For example, when silver behenate is employed as the long-chain fatty acid silver salt, it is typically desirable to have some behenic acid present to provide an improved image. A typical concentration of fatty acid is about 0.1 moles to about 2.0 moles of the fatty acid per mole of silver salt of long-chain fatty acids in the photothermographic element.

A photothermographic element as described can contain various synthetic polymeric binders alone or in combination as vehicles or binding agents and in various layers. Suitable materials are typically hydrophobic, but hydrophilic materials can be useful. They are transparent or translucent and include such substances as cellulose derivatives and synthetic polymeric substances such as polyvinyl compounds which are compatible with the described components of the photothermographic elements of the invention. Other synthetic polymeric materials which can be employed include dispersed vinyl compounds such as in latex form and particularly those which increase dimensional stability of photographic materials. Effective polymers include water insoluble polymers of alkyl acrylates and methacrylates, acrylic acid, sulfoalkyl acrylates or methacrylates, and those which have cross-linking sites which facilitate hardening or curing as well as those which have recurring sulfobetaine units as described in Canadian Pat. No. 774,054. Useful high molecular weight materials and resins include poly(vinyl butyral), cellulose acetate butyrate, polymethylmethacrylate, ethyl cellulose, polystyrene, poly(vinyl chloride), chlorinated rubber, polyisobutylene, butadiene-styrene copolymers, vinyl chloride-vinyl acetate copolymers, copolymers of vinyl acetate, vinyl chloride and maleic acid and poly(vinyl alcohol).

A so-called development modifier, also known as a toning agent, or an accelerator-toning agent or an activator-toning agent, may be used in photothermographic elements according to the invention to obtain a desired image. The so-called development modifier is typically useful at a concentration of about 0.01 moles to about 0.1 moles of development modifier per mole of silver salt oxidizing agent in the photothermographic material according to the invention. A typical useful so-called development modifier is a heterocyclic compound containing at least one nitrogen atom described as a toning agent in Belgian Pat. No. 766,590 issued June 15, 1971. Typical development modifiers include, for example, phthalimide, N-hydroxyphthalimide, N-hydroxy-1,8-naphthalimide, N-potassium phthalimide, N-mercury phthalimide, succinimide and N-hydroxysuccinimide. Other so-called development modifiers which can be employed include 1-(2H)-phthalazinone, 2-acetyl-phthalazinone and the like. If desired, combinations of development modifiers can be employed in the described photothermographic materials.

It is believed that the described development modifiers provide increased development rate in the described photothermographic materials as well as provide improved image discrimination. In some cases the so-called development modifiers provide increased photographic speed as well as improved tone. The mechanism by which these results are provided is not fully understood.

The components of a photothermographic material according to the invention described herein can be coated on a wide variety of supports to provide a photothermographic element including those described hereinabove for radiation sensitive elements. Useful supports must be capable of withstanding the processing temperatures employed for providing a developed image.

Spectral sensitizing dyes can be used conveniently to confer additional sensitivity to photothermographic elements of the present invention. For instance, additional spectral sensitization can be obtained by treating the photographic silver halide with a solution of a sensitizing dye in an organic solvent or the dye can be added in the form of a dispersion as described in British Pat. No. 1,154,781. The spectral sensitizing dye can either be added to the photothermographic composition as a final step or at some earlier stage in preparation of the composition.

Sensitizing dyes useful in sensitizing silver halide compositions according to the invention are described, for example, in U.S. Pat. Nos. 2,526,632 (Brooker et al.), issued Oct. 24, 1950; 2,503,776 (Sprague), issued Apr. 11, 1950 and 3,384,486 (Taber et al.), issued May 21, 1968. Spectral sensitizers, which can be used, include the cyanines, merocyanines, complex (trinuclear or tetranuclear) cyanines, holopolar cyanines, styryls, hemicyanines such as enamine, hemicyanines, oxonols and hemioxonols. Dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei described, as well as acid nuclei such as thiohydantoins, rhodanines, oxazolidenediones, thiazolidenediones, barbituric acids, thiazolineones and malononitrile. These acid nuclei can be substituted with alkyl, alkylene, phenyl, carboxyalkyl, sulfoalkyl, hydroxyalkyl, alkoxyalkyl, alkylamine groups or heterocyclic nuclei. Combinations of these dyes can be used, if desired. In addition, supersensitizing addenda which do not absorb visible light may be included such as, for instance, ascorbic acid derivatives, azaindenes, cadmium salts and organic sulfonic acid as described in U.S. Pat. Nos. 2,933,390 (McFall) et al., issued Apr. 19, 1960 and 2,937,089 (Jones et al.), issued May 17, 1970.

The sensitizing dyes and other addenda used in the photothermographic materials of the invention can be added from water solutions or useful organic solvents can be used. The compounds can be added using various procedures including those, for example, described in U.S. Pat. Nos. 2,912,343 (Collins et al.), issued Nov. 10, 1959; 3,342,605 (McCrossen et al.), issued Sept. 19, 1967; 2,996,287 (Audran), issued Aug. 15, 1961 and 3,425,835 (Johnson et al.), issued Feb. 4, 1969.

A variety of color-forming couplers are useful in the photothermographic elements of the present invention. The oxidized form of the reducing agent, preferably a sulfonamidophenol reducing agent, reacts with the coupler to form a dye imagewise in the exposed photothermographic element upon overall heating.

Preferred color-forming couplers include "four equivalent" color-forming couplers. Although it is appreciated that reactions in heated thermographic elements are not thoroughly understood at this time, and it is possible that the relative stoichiometry of the reactions of silver salt and color-forming coupler(s), respectively, may differ in thermographic reactions as compared with ordinary color photographic development processing, it should be understood that the term "four-equivalent" as used herein with regard to color-forming coupler compounds is intended to have the same meaning at it has in such conventional color processing art; that is, it encompasses color-forming coupler compounds which are "unsubstituted" at their respective "coupling position." For example, well-known four-equivalent yellow dye-forming couplers include those compounds having an active keto-methylene structure:

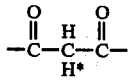

wherein the * denotes that "active" or coupling position of the coupler, or the point at which reaction of coupler with oxidized color developing material occurs to form the dye. Similarly, an example of a class of four-equivalent magenta and cyan dye-forming compounds, respectively, includes compounds having the structures:

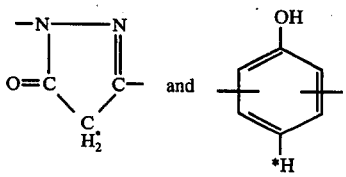

2-pyrazolin-5-one phenolic wherein the * designates the coupling position.

Many "four-equivalent" color-forming coupling compounds are known in the art, many examples of which can be found, for example, in U.S. applications Ser. No. 642,928 described hereinabove and U.S. Pat. Nos. 2,369,489; 2,875,057; 3,265,506; 2,474,293; and 2,772,162 as well as in many of the other publications referred to in Paragraph XXII "Color Materials," page 110 of *Product Licensing Index,* Vol. 92, December 1971 and on pages 822–5, Vol. 5, Kirk-Othmer, "Encyclopedia of Chemical Technology" and in Glafkides "Photographic Chemistry," Vol. 2, pages 596–614.

Some particularly useful four equivalent, color-forming couplers include 2-anilino-4-phenylthiazole, O-acetoacetaniside, 3-(γ-p-nitrophenylpropyl)-6-methyl-1H-pyrazolo-[3,2-C]-S-triazole, 5-[α-(2,4-di-tert-amylphenoxy)-hexanamido]-2-heptafluorobutyramidophenol, 1-(2,4,6-trichlorophenyl)-3-[3-(2,4-di-tert-amylphenoxyacetamido)benzamido]-5-pyrazolone, and α-pivalyl-2-chloro-5-[γ-(2,4-di-tert-amylphenoxy) butyramido] acetanilide.

In the photothermographic elements of the present invention, the concentration of each four equivalent, colorforming coupler used is typically within the range of from about 0.25 to about 4 moles per mole of reducing agent.

The described components of a photothermographic material can be in a variety of locations in a photothermographic element according to the invention, such as in various layers of a photothermographic element, depending upon the particular components, the desired image, processing conditions and the like. For example, the described photographic silver halide can be in a layer separate from the other components of the photothermographic material. It is often desirable, however, to employ the described components in a single layer of a photothermographic element for convenience of coating and the physical and photographic properties offered by fewer layers.

The photothermographic compositions can be coated on a suitable support by various coating procedures including dip coating, airknife coating, curtain coating or extrusion coating using hoppers such as described in U.S. Pat. No. 2,681,284 issued June 15, 1954. If desired, two or more layers can be coated simultaneously such as described in U.S. Pat. No. 2,761,791 (Russell), issued Sept. 4, 1956 and British Pat. No. 837,095.

Photothermographic elements according to the invention can contain photographic speed-increasing compounds, hardeners, antistatic layers, plasticizers and lubricants, coating aids, brighteners, spectral sensitizing dyes, absorbing and filtering dyes, each as described hereinabove and in the *Product Licensing Index,* Volume 92, December, 1971, publication 9232, pp. 107–110.

A process for producing a photographic image comprises the steps of:

(1) exposure of a photothermographic element to light, said element comprising a support having thereon a layer comprising a reducing agent, a silver salt oxidizing agent, and a silver halide; and (2) thermal development at a temperature above about 80° C.;

the improvement comprising incorporation into the photothermographic element, a free radical nitroxy bleaching agent having a formula selected from the group consisting of

I.

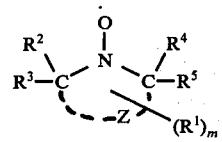

and

II.

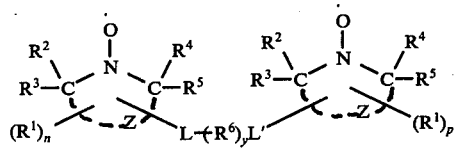

wherein Z, *y, m, n, p,* $R^1$, $R^2$, $R^3$, $R^4$, $R^5$, $R^6$, L and L′ are as defined hereinabove in the description of nitroxyl bleaching agents for photographic bleaching solutions. Bleaching of the silver present in the photothermographic element can provide a negative dye image or a positive image in the element, depending upon the components of the photothermographic materials selected.

A variety of exposure means is useful for providing a latent image in a photothermographic material as described. A latent image is typically provided by imagewise exposure to electromagnetic radiation which includes visible light. A latent image can be provided, for example, by imagewise exposure with, for instance, ultraviolet radiation, infrared radiation, a laser, electrical energy and the like. The exposure should be sufficient to provide a developable latent image in the described photothermographic material. Exposure above that which is necessary to provide a latent image can be employed if desired.

After imagewise exposure of the photothermographic material, a dye image can be developed in the photothermographic material by heating the photothermographic material to moderately elevated temperatures. A useful temperature for providing a black-and-white or a color image is within the range of about 80° C. to about 250° C. The photothermographic element is heated within the described range for a time sufficient to provide an image, typically for about 0.5 second to about 60 seconds. By increasing or decreasing the length of time of heating, a higher or lower temperature within the described range can be employed depending upon the desired image, the particular components of the photothermographic material and the like. A color image is typically provided within several seconds at a processing temperature of about 110° C. to about 165° C. and a black-and-white image is typically provided at a temperature of about 130° C. to about 180° C.

Any suitable means can be useful providing the desired processing temperature. The heating means can be a simple hot plate, iron, roller or the like.

Processing is usually carried out under ambient conditions of pressure and humidity. Conditions outside normal atmospheric pressure and humidity can be employed if desired.

The pH of a photothermographic composition useful in the photothermographic elements of the present invention can vary. In an aqueous formulation, it is typically less than about 7, such as from about 2 to about 6.

As described hereinabove for radiation sensitive elements, certain of the nitroxyl bleaching agents may be mixed with the coating composition of the photothermographic element and coated together in the same layer as the silver halide. These bleaching agents, such as Compound 2, Compound 6, Compound 13 do not interfere with either exposure, thermal development or any color-forming reactions if their redox potentials are such that the nitroxyl used does not oxidize the developer used. Following processing, the incorporated nitroxyl bleaching agent can be made to selectively bleach the silver image by introducing a suitable complexing agent for silver (I) ion. This latter agent suppresses the concentration of silver (I) ion, thereby promoting the bleaching of silver metal.

Other nitroxyl bleaching agents cannot be incorporated directly within the light sensitive emulsion layer without gross desensitization of the layer. These agents have substituents which are complexing ligands for silver (I) ion wherein the Ksp of the complexed product of the ligand and silver (I) is greater than about $10^{-12}$ at 25° C. These nitroxyl compounds can be coated in interlayers or overcoats such that development is completed before they diffuse into the silver emulsion layers and initiate bleaching.

Alternatively, nitroxyl bleaching agents and complexing agents or nitroxyl bleaching agents containing complexing ligands may be diffused into a developed photothermographic element from a second element such as an activator sheet or bleach cover sheet. This is particularly advantageous when the complexing agent or ligand is not compatible with the silver halide emulsions or when bleaching of color-forming photothermographic elements by bleaching solutions disclosed herein is not practical because the image dyes are soluble in the bleaching solvent, such as methanol, and may be undesirably removed from the elements.

The activator sheet may comprise a composition comprising meltable nonreactive solid, that is a thermal solvent, such as methylanisate, hexanediol, acetamide and the like; a suitable binder, such as poly(vinyl butyral), poly(vinyl pyrrolidone) and the like; and a suitable coating solvent, such as acetone, toluene, methylethylketone, methanol and the like, said composition coated on a support such as poly(ethylene terephthalate), or resin-coated paper and the like. The meltable solid diffuses into the photothermographic element when the sheet and photothermographic element are heated while in contact, and carries the bleaching agent and/or complexing agent with it into the bleachable layers of the element.

Instead of using a separate activator sheet, one can coat the activator composition described hereinabove as an overcoat on the photothermographic element. Upon thermal development, the thermal solvent diffuses into the image layers of the element carrying with it the bleaching chemistry.

Complexing agents useful in the present invention may be generated from complexing agent precursors, such as 1,8-(3,6-dioxaoctane)-bis-isothiouronium-p-toluene-sulfonic acid (DBI), and others described in U.S. Pat. No. 3,531,285. It is believed that these precursors slowly release complexing agents which, with the nitroxyl bleaching agents, bleach silver images during thermal development so that bleaching and development is accomplished in one heating step.

The following preparative methods illustrate how the nitroxyl bleaching agents useful in the present invention may be prepared.

PREPARATION 1 - PREPARATION OF COMPOUND 24

3-Amino-2,2,5,5-tetramethylpyrrolidine-1-oxyl (15.7 g) and triethylamine (25 g) were dissolved in acetonitrile (400 ml). While this solution was being stirred, isonicotinoyl chloride hydrochloride (17.8 g) was added to it and the stirring was continued at room temperature for 16 hours. The resulting precipitated salt was removed by filtration and discarded. The filtrate was then concentrated to dryness and the resulting residue was treated with ethyl acetate and washed with water. The ethyl acetate extracts were dried over magnesium sulfate, filtered, and concentrated to dryness, leaving a bright orange solid (10 g, m.p. 145°–150°). Recrystallization from ethyl acetate provided 6.9 g of Compound 24, having a very light yellow color (m.p. 160°–161° C.).

PREPARATION 2 - PREPARATIONS OF COMPOUNDS 2, 34 AND 41

Compounds 2, 34 (m.p. 147°–148° C.) and 41 (m.p. 146°–148° C.) were prepared in a manner similar to that utilized to prepare Compound 24 as described hereinabove.

PREPARATION 3 - PREPARATION OF COMPOUND 43

3-Amino-2,2,5,5-tetramethylpyrrolidine-1-oxyl (8 g) and propanesultone (6.1 g) were dissolved in dry benzene (100 ml). The resulting solution was refluxed on a steam pot for about 4 hours, then cooled. The resulting yellow crystallized solids (5.6 g, m.p. 200°–202° C.) were collected. A small sample of these solids was recrystallized in methanol to give purified Compound 43 (m.p. 205°–207° C.).

PREPARATION 4 - PREPARATION OF COMPOUND 40

Compound 40 was prepared in a manner similar to that utilized to prepare Compound 43 except that the amine used was 4-amino-2,2,6,6-tetramethylpiperidine-1-oxyl. The resulting product (8.8 g) was pink in color (m.p. > 260° C.).

PREPARATION 5 - PREPARATION OF COMPOUND 38

2,2,5,5-Tetramethyl-3-pyrroline-1-oxyl-3-carboxylic acid (13.6 g) was dissolved in dry tetrahydrofuran (300 ml). To this solution was added 1,1'-carbonyldiimidazole (12 g). After stirring the resulting solution for about 1 hour at room temperature, 4-amino-2,2,6,6-tetramethylpiperidine-1-oxyl (12.7 g) was added. Stirring was continued about 16 hours. The solution was then concentrated to dryness and ethyl acetate was added to the residue. The ethyl acetate extracts were then washed with water and dried using magnesium sulfate, filtered, and concentrated to dryness. Recrystallization of the residue from ethyl acetate provided the desired Compound 38 (2.4 g, m.p. 187°–189° C.).

PREPARATION 6 - PREPARATION OF COMPOUNDS 46 AND 47

2,2,5,5-Tetramethyl-3-carboxypyrroline-1-oxyl was treated with 1,1'-carbonyldiimidazole in dry tetrahydrofuran at room temperature for about 1 hour to prepare a solution of Compound 46. Compound 47 was prepared in a similar manner, but using 2,2,5,5-tetramethyl-3-carboxypyrrolidine-1-oxyl. These two compounds were generally used to prepare other useful nitroxyl derivatives, some of which are described below.

PREPARATION 7 - PREPARATION OF COMPOUNDS 38, 44, AND 48

Compounds 38, 44, and 48 were prepared by reacting Compound 46 with the appropriate amine in tetrahydrofuran. The reactant solutions were stirred at room temperature for about 16 hours, after which they were concentrated to dryness, placed in ethyl acetate and washed with water. The ethyl acetate extracts were then dried using magnesium sulfate, filtered and concentrated to dryness. The products obtained this way were usually recrystallized from an organic solvent. Compound 38 has a melting point of 187°–189° C.; Compound 44 has a melting point of 100°–102° C.; and Compound 48 has a melting point of 244°–245° C.

PREPARATION 8 - PREPARATION OF COMPOUND 27

Methylisothiocyanate (7.3 g) was added to a solution of 4-amino-2,2,6,6-tetramethylpiperidine-1-oxyl (17.1 g) in benzene (400 ml.) After stirring this solution at room temperature for about 16 hours, the resulting precipitated solids were collected on a funnel and 20.1 g of Compound 27 were obtained (m.p. 165° C.).

PREPARATION 9 - PREPARATION OF COMPOUND 25

Trichloroacetyl isocyanate (18.8 g) was added to a solution of 3-amino-2,2,5,5-tetramethylpyrrolidine-1-oxyl (15.7 g) in dry benzene (300 ml.) After stirring this solution for about 16 hours at room temperature, the resulting precipitated solids were collected on a funnel and 30.5 g of Compound 25 were obtained. Recrystallization from acetonitrile yielded 21.5 g of purified Compound 25 (m.p. 180°–182° C.).

PREPARATION 10 - PREPARATION OF COMPOUND 35

Triethylamine (10 g) was added to a solution of 3-amino-2,2,5,5-tetramethylpyrrolidine-1-oxyl (15.7 g) in benzene (200 ml). Trifluoroacetic anhydride (21 g) was then added to the solution. After stirring this solution at room temperature for about 16 hours, the solution was placed in a separatory funnel and washed with water. Benzene extracts were dried using magnesium sulfate and filtered; and the filtrate was concentrated to dryness. The solid residue which remained was recrystallized from a solution of 150 ml of hexane and 50 ml of ethyl acetate. About 12 g of Compound 35 (m.p. 119°–120° C.) were obtained.

PREPARATION 11 - PREPARATION OF COMPOUND 36

Compound 36 was prepared in a manner similar to that used to prepare Compound 35 described hereinabove except that 4-amino-2,2,6,6-tetramethylpiperidine-1-oxyl was used. About 6 g of Compound 36 (m.p. 152°–154° C.) were obtained after recrystallization from a solution of hexane and ethyl acetate.

PREPARATION 12 - PREPARATION OF COMPOUND 39

Triethylamine (10 g) was added to a solution of 3-amino-2,2,5,5-tetramethylpyrrolidine-1-oxyl (15.7 g) and acetonitrile (500 ml). Trichloroacetyl chloride (18.2 g) was then added dropwise to this solution. After stirring this solution at room temperature for about 16 hours, the resulting precipitated salt was collected on a funnel and discarded. The filtrate was concentrated to dryness and the solid residue which remained was dissolved in ethyl acetate. This solution was then washed with water, dried using magnesium sulfate and filtered. The filtrate was concentrated to dryness. The yellow solid residue which remained was recrystallized from ethyl acetate and provided 6.3 g of Compound 39 (m.p. 161°–163° C.).

PREPARATION 13 - PREPARATION OF COMPOUND 37

Triethylamine (30 g) was added to a solution of 4-amino-2,2,6,6-tetrapiperidine-1-oxyl (34.2 g) and acetonitrile (500 ml). Methanesulfonylchloride (23 g) was then added to this solution. After stirring this solution at room temperature for about 16 hours, the solvent was removed almost to dryness. The resulting precipitated salts were collected on a funnel, washed with ethyl acetate and then discarded. The filtrate was treated with ethyl acetate and washed with water. The ethyl acetate extracts were dried using magnesium sulfate, filtered and then concentrated to dryness. The resulting solid which remained was recrystallized from ethyl acetate and provided 26.5 g of Compound 37 (m.p. 140°–142°).

Compounds 1, 3, 4, 7, 9, 21, 22, 32 and 50 are known compounds and their preparations are described in Free Nitroxyl Radicals by E. G. Rozanstev, Plenum Press, 1970. Some are commercially available from such companies as Eastman Organic Chemicals, Aldrich, PCR Inc., and others.

The following examples are included to illustrate the practice of the invention:

EXAMPLE 1 - BLEACHING OF PRE-FORMED SILVER

A 16 mm × 30.4 cm sample of a test coating comprising silver particles (average diameter 140A) dispersed in unhardened gelatin and coated on a polyester film support at 100 mg silver per square meter was partially immersed in an aqueous bleaching solution consisting of Compound 1 (0.1 M) and N,N,N',N'-tetramethyl-p-phenylenediamine ($1 \times 10^{-3}$M). The effective hydrogen ion concentration measured at 23° C. was $3 \times 10^{-7}$.

After 5 minutes, 98% of the metallic silver was removed from the film structure.

EXAMPLES 2 and 3 -BLEACHING SILVER FROM COLOR PHOTOGRAPHIC ELEMENTS

Exposed samples of three single-layer photographic elements, identified below, which contain cyan, magenta and yellow dye-forming couplers, respectively, were color developed, fixed, washed and dried to give a maximum density of silver and dye. Separate samples were then immersed at 25° C. in a ferricyanide bleaching solution acting as the control (Example 2) and in a bleach solution of the present invention comprising (Example 3):

| | | |
|---|---|---|
| Compound No. 1 | 0.3426 | g |
| N,N,N',N'-tetramethyl-p-phenylenediamine | 0.0237 | g |
| Hydrochloric acid (0.25 N) | 20.0 | ml |

After the bleaching time indicated in Table I, the samples were fixed for 8 minutes, washed and dried; and the amount of residual silver was measured. No measurable loss in dye density was apparent in any of the coatings after bleaching.

| | |
|---|---|
| Coating A | |
| Silver bromoiodide emulsion | 200 mg Ag/ft$^2$ (2100 mg/m$^2$) |
| Gelatin | 500 mg/ft$^2$ (5250 mg/m$^2$) |
| Cyan coupler, 5-[α-(2,4-di-tert-amylphenoxy)-hexanamido]-2-heptafluoro-butyramidophenol | 300 mg/ft$^2$ (3150 mg/m$^2$) |
| Di-n-butyl phthalate (coupler solvent) | 150 mg/ft$^2$ (1575 mg/m$^2$) |
| Coating B | |
| Silver bromoiodide emulsion | 200 mg Ag/ft$^2$ (2100 mg/m$^2$) |
| Gelatin | 500 mg/ft$^2$ (5250 mg/m$^2$) |
| Magenta coupler 1-(2,4,6-trichlorophenyl)-3-[3-(2,4-di-tert-amylphenoxyacetamido) benzamido]-5-pyrazolone | 310 mg/ft$^2$ (3250 mg/m$^2$) |
| Di-n-butyl phthalate (coupler solvent) | 155 mg/ft$^2$ (1570 mg/m$^2$) |
| Coating C | |
| Silver bromoiodide emulsion | 200 mg Ag/ft$^2$ (2100 mg/m$^2$) |
| Gelatin | 500 mg/ft$^2$ (5250 mg/m$^2$) |
| Yellow coupler α-pivalyl-2-chloro-5-[γ-(2,4-di-tert-amylphenoxy) butyramido] acetanilide | 264 mg/ft$^2$ (2800 mg/m$^2$) |
| Di-n-butyl phthalate (coupler solvent) | 132 mg/ft$^2$ (1390 mg/m$^2$) |

The residual silver listed in Table I is given as the percent by weight of the total silver in the photographic element.

Table I

| Coating | Control (Example 2) (time) | pH | Test Bleach (Example 3) (time) | Residual Ag° |
|---|---|---|---|---|
| A | 8′ | 8.50 | — | 5% |
| A | — | 0.65 | 8′ | 8% |
| A | — | 0.65 | 20′ | 8% |
| B | 8′ | 8.50 | — | 6% |
| B | — | 0.65 | 8′ | 6% |
| B | — | 0.65 | 20′ | 6% |
| C | 8′ | 8.50 | — | 5% |
| C | — | 0.65 | 8′ | 18% |
| C | — | 0.65 | 20′ | 10% |

These examples show that the bleaching solutions of the present invention bleach silver from color photographic elements as well as conventional ferricyanide bleaches, but at lower pH.

EXAMPLES 4–7 - BLEACHING OF BLACK AND WHITE PHOTOGRAPHIC ELEMENTS

Samples of a panchromatic (black and white) film were exposed to room light, developed to maximum silver density, fixed, washed and dried. Samples of the elements were then immersed in the aqueous solution of Table II and the bleaching rate was measured as the time required to reduce the silver density of each sample to 10% of its original density. The pH was adjusted with hydrochloric acid.

Table II

| Bleach Solution | Amount of Compound 1 | pH | Bleach Rate |
|---|---|---|---|
| Example 4 (Control) | none | 4.0 | No bleaching |
| Example 5 | 0.1M | 7.0 | 20 minutes |
| Example 6 | 0.1M | 4.0 | 5–10 minutes |
| Example 7 | 0.1M | 4.0 | 5 minutes |

The solution in Example 7 contained 0.05M concentration of the catalyst N,N,N′,N′-tetramethyl-p-phenylenediamine. Each other solution contained 0.05M of a catalyst having the formula:

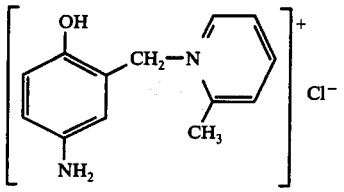

These examples show that the nitroxyl compounds of the present invention are useful as bleaching agents for developed silver.

EXAMPLES 8–15 - BLEACHING SILVER FROM PHOTOTHERMOGRAPHIC ELEMENTS

Samples of a hydrophobic photothermographic element comprising a polyethylene coated paper support having a layer containing the following components were coated at 60 mg total silver per square foot:

Silver bromoiodide (light-sensitive component)
Silver stearate/lithium stearate dispersion (silver source)
2,6-Dichloro-4-benzenesulfonamidophenol (developer)
N-hydroxynaphthalimide (toner)
Poly(vinyl butyral)

These samples were exposed for 1 second through a line copy image by a General Electric Photoflood lamp at a distance of 18 inches and thermally developed to maximum density by contacting the back of the element's support for 6 seconds to the curved surface of a heated block at 135° C. Separate developed samples were then immersed in the bleaching solutions of Table III and the bleaching rate of each was measured as the time required to reduce the reflection density to less than 10% of its original $D_{max}$.

Table III

| Example | Bleaching Agent (molar conc.) | Solvent | Catalyst | Bleaching Rate |
|---|---|---|---|---|
| 8 (control) | none | Methanol | *($10^{-3}$M) | no bleaching |
| 9 (control) | none | Methanol | **($10^{-3}$M) | no bleaching |
| 10 | 1(0.1M) | Methanol | *($10^{-3}$M) | 80 minutes |
| 11 | 1(0.1M) | Methanol | *($10^{-2}$M) | 200 seconds |
| 12 | 1(0.1M) | Methanol | **($10^{-2}$M) | 60 seconds |
| 13 | 5(0.1M) | Methanol | **($10^{-3}$M) | 40 minutes |
| 14 | 5(0.1M) | Methanol | **($10^{-2}$M) | 50 seconds |

Table III-continued

| Example | Bleaching Agent (molar conc.) | Solvent | Catalyst | Bleaching Rate |
|---|---|---|---|---|
| 15 | 5(0.1M) | Methanol | *($10^{-2}$M) | 120 seconds |

*This is the catalyst disclosed hereinabove in Examples 4–7.

**This catalyst is N,N,N',N'-tetramethyl-p-phenylenediamine, disclosed in U.S. Patent 3,707,374 (Vander Voorn), issued December 26, 1972.

EXAMPLES 16–31 - BLEACHING PHOTOTHERMOGRAPHIC ELEMENTS USING VARIOUS NITROXYL BLEACHING AGENTS

A photothermographic element was prepared and tested in various bleaching solutions as described in Examples 8–15. The bleaching rates of these solutions are recorded in Table IV. Each solution was 0.25M in the bleaching agent with methanol as the solvent. Solution pH's are -log of effective hydrogen ion concentration in methanol as measured vs. Pt electrodes at 23° C. The low values of pH were adjusted with hydrochloric acid. The catalysts are the same as those identified hereinabove in Examples 8–15.

Table IV

| Ex. | Bleaching Agent (Compound No.) | Catalyst($10^{-3}$M) | pH | Bleaching Rate |
|---|---|---|---|---|
| 16 | 13 | * | 7.0 | 30 seconds |
| 17 | 6 | * | 7.0 | 30 seconds |
| 18 | 1 | * | 7.0 | 10 seconds |
| 19 | 1 | * | 1.0 | 15 seconds |
| 20 | 12 | * | 7.0 | 120 seconds |
| 21 | 4 | * | 7.0 | 15 seconds |
| 22 | 23 | * | 7.0 | 5 minutes |
| 23 | 5 | * | 7.0 | 25 seconds |
| 24 | 5 | ** | 7.0 | 30 seconds |
| 25 | 5 | none | 2.0 | 15 seconds |
| 26 | 10 | none | 2.0 | 15 minutes |
| 27 | 24 | none | 2.0 | 5 minutes |
| 28 | 25 | none | 2.0 | 5 minutes |
| 29 | 26 | none | 2.0 | 2 minutes |
| 30 | 27 | none | 4.0 | 2 minutes |
| 31 | 28 | none | 4.0 | 3 minutes |

EXAMPLES 32 and 33 - BLEACH-FIX SOLUTIONS OF NITROXYL COMPOUNDS

Two 0.25M solutions of Compounds 27 and 28, respectively, were prepared with methanol as the solvent and adjusted to an effective hydrogen ion concentration of $10^{-5}$ with HCl.

These solutions were then tested as bleach-fix solutions containing 0.5M of fixing agent thiourea (solutions which remove both metallic silver and silver ion) by immersing separately developed samples of the hydrophobic photothermographic element of Examples 8–15 in each of the solutions for 5 minutes. After washing and drying the samples, they were analyzed for silver. None was found, indicating complete removal by the bleach-fix solutions described in the present invention.

EXAMPLE 34 - BLEACHING OF COPPER METAL

Copper particles having an average diameter of 100 microns were suspended in an aqueous solution comprising nitroxyl bleaching agent Compound 1 (0.1M), N,N,N',N'-tetramethyl-p-phenylenediamine (0.1M) and $NH_4Br$ (1.0M) at 25° C. and pH 5.0. The copper particles were completely dissolved within 10 seconds, indicating that the nitroxyl bleaching agent effectively bleaches copper metal.

EXAMPLES 35–49 - BLEACHING AGENTS IN PHOTOTHERMOGRAPHIC ELEMENTS

Photothermographic elements which normally produce substantially neutral images having various nitroxyl bleaching agents incorporated therein were prepared by coating a poly(ethylene terephthalate) film support with the following nonaqueous coating composition at a 6.0 mil wet thickness:

| | | |
|---|---|---|
| 1,1'-bis-2-naphthol | 0.3 | mmole |
| AgBrI (6 mole percent iodide; in acetone and peptized with poly(vinyl butyral)) | 0.3 | mmole |
| Silver behenate | 0.3 | mmole |
| Behenic acid | 0.3 | mmole |
| Bleaching agent (see Table V) | 0.25 | mmole |
| Poly(vinyl butyral), 2% solution in 1:1 methanol/toluene | 2.0% | of total weight of polymer |

PROCESS A

To evaluate for affect on thermal developability due to the presence of a nitroxyl compound, samples of the photothermographic elements prepared above were imagewise exposed and uniformly heated for 30 seconds by contact with a metal block heated to 135° C. Density results of the negative silver images plus imagewise dye thus produced are recorded in Table V.

PROCESS B

To determine the efficiency of the incorporated nitroxyl compounds to bleach metallic silver, predeveloped samples obtained by Process A above were heated in face-to-face contact with samples of an activator sheet described below for 30 seconds at 125° C. If bleaching occurred to a reasonable degree, the silver image disappeared and a yellow dye image was revealed. The yellow image was the oxidized product of the 1,1'-bis-2-naphthol developing agent. The degree of bleaching for each element, as determined by visual observation, is recorded in Table V.

An activator sheet was made by coating the following composition at a wet thickness of 6.0 mil on a poly(ethylene terephthalate) film support:

| | |
|---|---|
| Silver ion complexing agent having the formula | 250 mg |

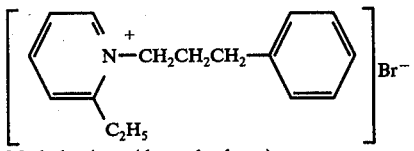

| | |
|---|---|
| Methyl anisate (thermal solvent) | 500 mg |
| Poly(vinyl butyral) solution (2% solution in 1:1 methanol/toluene) | 9 ml |
| Acetone | 2 ml |

Table V

| Example | Bleaching Agent (Compound No.) | Development $D_{max}$ | Development $D_{min}$ | Bleaching |
|---|---|---|---|---|
| 35 (control) | none | 1.3 | 0.11 | none |
| 36 | 1 | 1.3 | 0.11 | complete |
| 37 | 5 | 1.3 | 0.11 | complete |
| 38 | 6 | 0.9 | 0.02 | complete |
| 39 | 24 | 1.4 | 0.20 | complete |
| 40 | 36 | 1.3 | 0.06 | complete |
| 41 | 37 | 1.3 | 0.08 | complete |
| 42 | 30 | 1.3 | 0.08 | complete |
| 43 | 9 | Weak development (faint image, $D_{max}$ 0.3) | | partial |
| 44 | 26 | Foggy development ($D_{min}$ 0.8) | | complete |
| 45 | 34 | 1.4 | 0.20 | complete |
| 46 | 38 | Foggy development | | partial |
| 47 | 43 | Foggy development | | complete |
| 48 | 44 | 1.4 | 0.08 | complete |
| 49 | 48 | 0.9 | 0.10 | partial |

EXAMPLES 50–53 - INCORPORATION OF NITROXYL BLEACHING AGENTS IN NEGATIVE-WORKING COLOR PHOTOTHERMOGRAPHIC ELEMENTS

Color photothermographic elements were prepared by coating a poly(ethylene terephthalate) film support with the following composition at a 6.0 mil wet thickness:

| | |
|---|---|
| Poly(vinyl butyral) solution (1.78% solution in methanol/toluene/acetone mixture) | 7.0 ml |
| Developer having formula | 0.275 mmole |

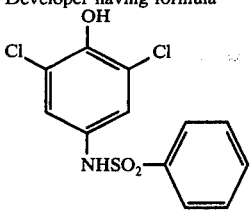

| | |
|---|---|
| Bleaching agent | 0.275 mmole |
| AgBrI emulsion (peptized with poly(vinyl butyral)) | 0.33 millimoles |
| Silver behenate/behenic acid dispersion (in 1.78% solution of polyvinyl butyral) | 0.33 millimoles (Vol. = 3.0 ml) |
| Magenta-dye-forming coupler having the formula | 0.275 mmole |

-continued

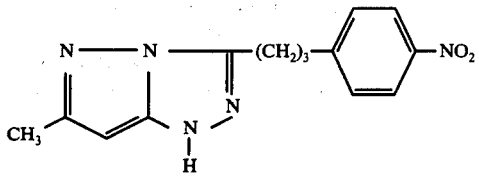

Samples of separate coatings containing no bleaching agent (Control, Example 50) and Compounds 1, 5 and 24 (Examples 51–53), respectively, as the bleaching agents, were imagewise exposed and thermally developed by uniform heating on a metal block heated to 110° C. Post-development bleaching of the negative silver images thus produced was initiated by heating the developed samples for 30 seconds in face-to-face contact with samples of the activator sheet described in Examples 35–49 on a metal block heated to 125° C.

The following observations were made:

The sample containing Compound 24 produced an excellent silver image and magenta dye image after the initial development step and exhibited approximately 0.3 log E increase in speed when compared to the control. The subsequent bleaching step produced a well-defined negative magenta image and the silver image was completely bleached. The silver in the control samples were not bleached.

The sample containing Compound 5 produced a silver and dye image exhibiting a significantly high amount of $D_{min}$, i.e. fog, but was effective in completely bleaching the silver image.

The sample containing Compound 1 exhibited significant desensitization and complete inhibition of dye formation. Although the compound was effective in bleaching the silver image, which was produced with extended exposure and processing, no dye image was observed in the processed sample.

EXAMPLES 54 AND 55 - BLEACHING OF COLOR PHOTOTHERMOGRAPHIC ELEMENTS

Photothermographic elements similar to the type described in Examples 50–53 were prepared using the following bleaching agents and adding dye-forming couplers:

| Example | Coupler | Bleaching Agent |
|---|---|---|
| 54 | 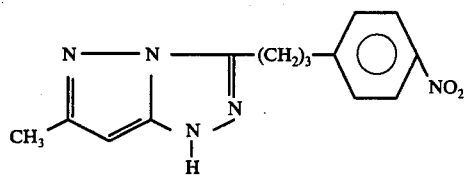 | Compound 30 |
| 55 | 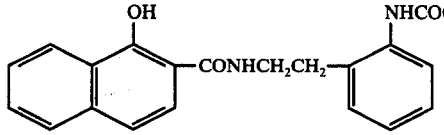 | Compound 34 |

Exposed samples of the elements were thermally developed and bleached according to the procedure described in Examples 35–49. In both Examples 54 and 55, excellent silver and dye images were produced after development; and the silver images were completely bleached in the subsequent bleaching process.

EXAMPLES 56–62 - NITROXYL BLEACHING AGENTS IN POSITIVE-WORKING COLOR PHOTOTHERMOGRAPHIC ELEMENTS

Color photothermographic elements were prepared by coating poly(ethylene terephthalate) film supports with the following composition at a 6.0 mil wet thickness:

| | | |
|---|---|---|
| Silver behenate | 0.3 | mmole |
| Behenic acid | 0.3 | mmole |
| AgBrI emulsion peptized with poly(vinyl butyral) | 0.3 | mmole |
| Dye (developer and image dye; see Table VI) | 0.05 | mmole |
| Phthalazinone (toner-accelerator) | 10.0 | mg |
| Bleaching agent (see Table VI) | 0.275 | mmole |
| Poly(vinyl butyral) in 1:1 acetone/toluene | 2.5 | total wt. % |

Samples of the elements containing the dyes and bleaching agents listed in Table VI were imagewise exposed and thermally developed by uniform heating for 15 seconds on a metal block heated to 135° C. A positive dye image could then be transferred to a mordanted receiver sheet moistened in methanol. Alternatively, the developed samples were heated in face-to-face contact with samples of the activator sheet described in Examples 35–49 for 30 seconds on a metal block heated to 125° C. to induce bleaching of the silver image. In each sample, negative silver images and positive dye images were observed after thermal development. After the heat treatment with an activator sheet, the silver image of each sample was either completely or partially bleached to provide positive dye transparencies.

Table VI

| Example | Bleaching Agent (Compound No.) | Dye | Development | Bleaching Activity |
|---|---|---|---|---|
| 56 | 30 | A | Good Ag° | Weak |
| 57 | 32 | A | Good Ag° | Excellent |
| 58 | 35 | A | Good Ag° | Excellent |
| 59 | 25 | A | Good Ag° | Excellent |
| 60 | 1 | B | Foggy ($D_{min}$>0.5) | Excellent |
| 61 | 1 | A | Foggy ($D_{min}$>0.5) | Excellent |
| 62 | 30 | C | Partial | Weak |

Table VI-continued

| Example | Bleaching Agent (Compound No.) | Dye | Development | Bleaching Activity |
|---|---|---|---|---|
| | | | ($D_{max}$<0.5) | |

Dye A has the formula:

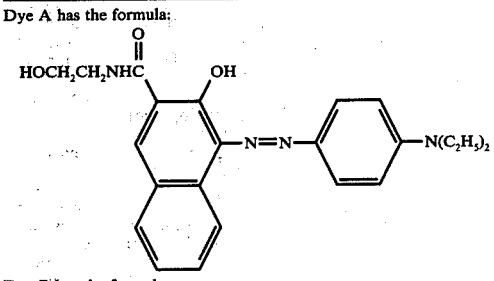

Dye B has the formula:

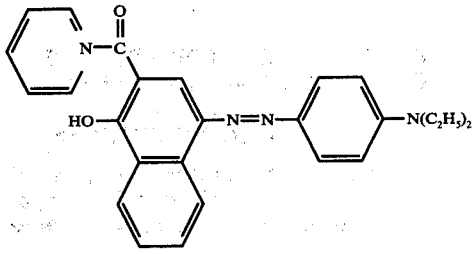

Dye C has the formula:

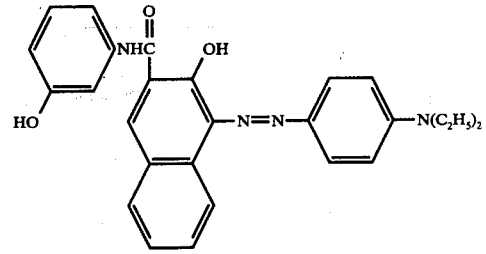

EXAMPLES 63–80 - THERMAL DIFFUSION OF NITROXYL BLEACHING AGENTS IN PHOTOTHERMOGRAPHIC ELEMENTS

The nitroxyl bleaching agent can be separated from the photothermographic element containing the color-forming addenda during the exposing the thermal processing of the element by putting the agent in an activator sheet. It can then be introduced to the color-forming layer by thermally diffusing both the bleach and a complexing agent into the emulsion layer from the activator coating. This has the advantage of allowing the use of more powerful and otherwise incompatible bleaching agents. The diffusion of materials is facilitated by the use of a thermal solvent in one or both of the coatings. The laminant can be left together permanently or separated. The final image will not revert back to Ag° if the sequestering agent adequately renders the $Ag^+$ of the coating insensitive to light. A color transparency results.

PROCEDURE

Photothermographic elements were prepared exactly as described in Examples 35–49; 50–53; and 56–62, respectively, except that the bleaching agents were omitted from the coating compositions. The elements numbered in Table VII were as follows:

I - Like Examples 35–49 but the bleaching agent was omitted

II - Like Example 55 but the bleaching agent was omitted

III - Like Example 56 (containing dye A) but the bleaching agent was omitted.

Bleaching activator sheets were prepared exactly as described in Examples 35–49 (Process B) except that the coating compositions also contained 0.3 mmoles of one of the nitroxyl bleaching agents listed in Table VII.

Exposed and thermally developed samples of the photothermographic elements were heated in face-to-face contact for 120 seconds at 85° C. and/or 30 seconds at 135° C. with samples of one of the activator sheets containing a bleaching agent.

The results are summarized in Table VII.

Table VII

| Example | Photothermographic Element | Bleaching Agent (Compound No.) | Result |
|---|---|---|---|
| 63 | I | 1 | Bleached completely in 20 seconds at 85° C |
| 64 | II | 1 | Bleached completely in 30 seconds at 125° C; cyan image |
| 65 | I | 5 | Bleached completely in 30 seconds at 85° C |
| 66 | II | 5 | Bleached completely in 30 seconds at 85° C; good cyan image |
| 67 | III | 5 | Bleached completely in 10 seconds at 85° C; excellent blue dye positive |
| 68 | I | 34 | Bleached completely in 20 seconds at 85° C |
| 69 | II | 34 | Bleached completely in 30 seconds at 85° C; cyan dye |
| 70 | I | 37 | Bleached completely in 30 seconds at 85° C |
| 71 | II | 37 | Bleached completely in 40 seconds at 85° C; cyan dye |
| 72 | I | 12 | Bleached completely in 30 seconds at 85° C |
| 73 | II | 33 | Bleached completely in 15 seconds at 85° C cyan dye |
| 74 | I | 33 | Bleached completely in 15 seconds at 85° C; cyan dye |
| 75 | I | 27 | Bleached completely in 60 seconds at 135° C |
| 76 | I | 24 | Bleached completely in 45 seconds at 85° C |
| 77 | II | 24 | Bleached completely in 40 seconds at 85° C; |
| 78 | III | 24 | Bleached completely in 10 seconds at 85° C; excellent blue dye positive |
| 79 | I | 26 | Bleached completely in 60 seconds at 85° C |
| 80 | I | 28 | Bleached completely in 180 seconds at 85° C |

EXAMPLES 79–82 - BLEACHING WITHOUT COMPLEXING AGENT

Several of the nitroxyls bearing silver ion complexing substituents were coated in an activator sheet like that described in Examples 63–80, except that the complexing agent was left out. These examples show that such molecules can serve a dual purpose. The processing was like that described in Examples 63–80 and the results are summarized in Table VIII.

Table VIII

| Example | Photothermographic Element (Ex. 61–78) | Bleaching Agent (Compound No.) | Result |
|---|---|---|---|
| 81 | I | 33 | Complete bleach (C.B.) in 20 seconds at 85° C |
| 82 | III | 33 | C.B. in 10 seconds at 85° C (excellent positive dye image) |
| 83 | I | 19 | C.B. in 30 seconds at 85° C |
| 84 | I | 27 | Partial bleach in 180 seconds at 85° C |

EXAMPLE 85 - ONE-STEP DEVELOPMENT AND BLEACHING

A photothermographic element was prepared by coating a poly(ethylene terephthalate) film support with a layer exactly as described in Examples 50–53. Compound 32 (0.275 mmoles) of the present invention was incorporated as the bleaching agent. The dried layer was then overcoated with a 5% aqueous solution of a polyvinyl alcohol at 3.0 mil wet thickness and allowed to air dry. A third layer was then applied at 3.0 mil wet thickness with a 5% aqueous solution of polyvinyl alcohol containing 250 mg acetamide as a thermal solvent and 150 mg of the $Ag^+$ complexing agent of Examples 35–49.

Samples of the dried tri-layer structure were imagewise exposed with a GE Photoflood lamp at 240 fc. The exposed coating was uniformly heated by contacting the support to a curved heating block for 30 seconds at 125° C. A silver image appeared almost immediately, then began to disappear after approximately 15 seconds, until at 30 seconds, only a magenta image remained in the exposed areas.

The result indicates that the initial development and coupling proceeded before the complexing agent diffused into the emulsion and initiated bleaching by the incorporated oxidant. A similar result was obtained by replacing the magenta-dye-forming coupler of Examples 50–53 with the coupler of Example 55.

EXAMPLE 86 - NITROXYL BLEACHING AGENT INCORPORATED INTO NON-LIGHT SENSITIVE LAYER OF PHOTOTHERMOGRAPHIC ELEMENT

A photothermographic element was prepared by coating a poly(ethylene terephthalate) film support with a layer exactly as described in Example 85 except that the nitroxyl bleaching agent was omitted. A second and third layer were then applied as described in Example 85 except that the third layer contained 0.275 mmole of Compound No. 1 in addition to the thermal solvent and complexing agent.

The element was exposed and processed as described in Example 85 and similar results were obtained. This technique is particularly suitable for the use of nitroxyl bleaching agents which may have adverse effects when incorporated directly in the light-sensitive layer.

EXAMPLE 87 - ONE-STEP DEVELOPMENT AND BLEACHING WITH COMPLEXING AGENT PRECURSOR

A single-layer photothermographic element was prepared by coating a poly(ethylene terephthalate) film support with a layer exactly as described in Example 85 but which also contained 0.25 mmoles of 1,8-(3,6-dioxaoctane)-bis-isothiouronium-p-toluene-sulfonic acid (DBI), a complexing agent precursor.

An exposed sample of the element was processed by heating the sample for 30 seconds on a metal block heated to 135° C. A negative magenta dye image was obtained in which partial silver bleaching has occurred. It is believed that this shows that during the thermal development which produced a negative silver and dye image, the DBI precursor released the complexing agent, bleaching the silver image in a single heating step.

The invention has been described in detail with particular reference to preferred embodiments thereof, but it will be understood that variations and modifications can be effected within the scope of the invention.

What is claimed is:

1. A photothermographic element comprising a support having thereon a layer comprising:

a. a reducing agent which provides a developed image within about 90 seconds at a temperature of about 100° to 250° C. upon heating said element;

b. an organic silver salt oxidizing agent; and c. a silver halide; and, in the same or a different layer, a stable free radical nitroxyl bleaching agent having a formula selected from the group consisting of:

I.

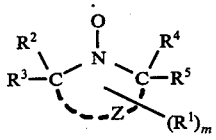

and

II.

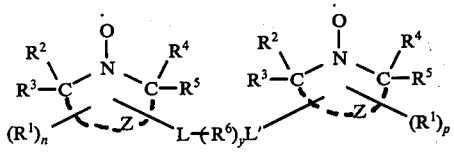

wherein Z comprises the nonmetallic atoms necessary to complete a 5 to 7 member heterocyclic ring; $y$ is 0 or 1; $m$, $n$ and $p$ are independently selected from the group of integers of 1 to 4, $R^1$ is independently selected from the group consisting of hydrogen, alkyl, amino, aryl, cycloalkyl, hydroxy, hydroxyimino, imino, isothiocyanato, oxo, a 5 to 10 member nonmetallic heterocyclic ring, a complexing ligand for silver (I) ion wherein the Ksp of the complexed product of the ligand and silver (I) ion is less than about $10^{-12}$ at 25° C., and —L—$R^9$; L and L' are the same or different and are linking groups selected from the group consisting of amino, carbonamido, ureylene, thioureylene, oxymethylenecarbonamido, carbonyloxy, carbonyldioxy, oxycarbonyl, carbonyl, sulfonamido, amidothiocarbonyl, oxymethyleneoxycarbonyl and dicarbonamido; $R^9$ is selected from the group consisting of hydrogen, alkyl, aryl, alkenyl, aryloxy, hydroxy, amino, a cation of a quaternary ammonium salt and a 5 to 10 member nonmetallic heterocyclic ring; and $R^6$ is selected from the group consisting of alkylene, cycloalkylene, arylene, a 5 to 7 member bivalent nitrogen-containing heterocycle, and a thio-interrupted alkylene chain; and $R^2$, $R^3$, $R^4$ and $R^5$ are independently selected from the group consisting of alkyl, cycloalkyl, aralkyl, aryl, or $R^2$ and $R^3$ or $R^4$ and $R^5$ can be taken together with the carbon atom of the ring to which they are attached to form a cycloalkyl or cycloalkenyl having from 4 to 10 carbon atoms.

2. The photothermographic element of claim 1 wherein the reducing agent is a sulfonamidophenol.

3. The photothermographic element of claim 1 wherein the organic silver salt oxidizing agent is a silver salt of a fatty acid.

4. The photothermographic element of claim 1 wherein the nitroxyl bleaching agent has the formula:

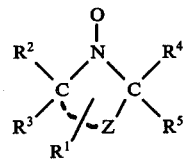

wherein Z comprises the nonmetallic atoms necessary to complete a 5 or 6 member heterocyclic ring; $R^2$, $R^3$, $R^4$ and $R^5$ are independently selected from the group consisting of alkyl, cycloalkyl, aralkyl, aryl, or $R^2$ and $R^3$ or $R^4$ and $R^5$ can be taken together with the carbon atom of the ring to which they are attached to form a cycloalkyl or cycloalkenyl having from 4 to 10 carbon atoms; and $R^1$ is selected from the group consisting of alkyl, amino, cycloalkyl, hydroxy, hydroxyimino, imino, isothiocyanato, oxo and a 5 to 10 member heterocyclic ring.

5. The photothermographic element of claim 4 wherein the nitroxyl bleaching agent has the formula:

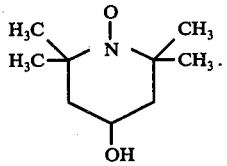

6. The photothermographic element of claim 1 which further comprises at least one binder.

7. The photothermographic element of claim 1 which further comprises at least one color-forming coupler.

8. The photothermographic element of claim 1 wherein the silver halide is silver bromoiodide.

9. A photothermographic element comprising a support having thereon a layer comprising:

a. a sulfonamido phenol reducing agent;

b. a silver salt of a fatty acid;

c. a silver halide;

d. at least one binder; and e. at least one color-forming coupler; and, in the same or a different layer, a nitroxyl bleaching agent having the formula:

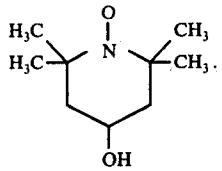

10. A photothermographic element comprising a support having thereon a layer comprising:

a. a reducing agent which provides a developed image within about 90 seconds at a temperature of about 100° to 250° C. upon heating said element;

b. an organic silver salt oxidizing agent; and c. a silver halide;

another layer comprising a silver (I) ion complexing agent wherein the Ksp of the complexed product of silver (I) ion and the complexing agent is less than about $10^{-12}$ at 25° C; and in the same or a different layer, a stable free radical nitroxyl bleaching agent having a formula selected from the group consisting of:

I.

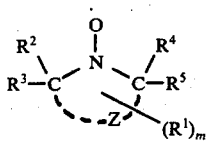

and

II.

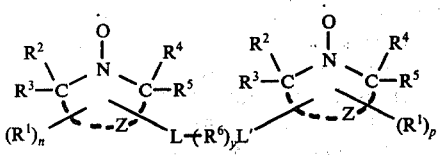

wherein Z comprises the nonmetallic atoms necessary to complete a 5 to 7 member heterocyclic ring; $y$ is 0 or 1; $m$, $n$ and $p$ are independently selected from the group of integers of 1 to 4, $R^1$ is independently selected from the group consisting of hydrogen, alkyl, amino, aryl, cycloalkyl, hydroxy, hydroxyimino, imino, isothiocyanato, oxo, a 5 to 10 member nonmetallic heterocyclic ring, a complexing ligand for silver (I) ion wherein the Ksp of the complexed product of the ligand and silver (I) ion is less than about $10^{-12}$ at 25° C., and —L—$R^9$; L and L' are the same or different and are linking groups selected from the group consisting of amino, carbonamido, ureylene, thioureylene, oxymethylenecarbonamido, carbonyloxy, carbonyldioxy, oxycarbonyl, carbonyl, sulfonamido, amidothiocarbonyl, oxymethyleneoxycarbonyl and dicarbonamido; $R^9$ is selected from the group consisting of hydrogen, alkyl, aryl, alkenyl, aryloxy, hydroxy, amino, a cation of a quaternary ammonium salt and a 5 to 10 member nonmetallic heterocyclic ring; and $R^6$ is selected from the group consisting of alkylene, cycloalkylene, arylene, a 5 to 7 member bivalent nitrogen-containing heterocycle, and a thio-interrupted alkylene chain; and $R^2$, $R^3$, $R^4$ and $R^5$ are independently selected from the group consisting of alkyl, cycloalkyl, aralkyl, aryl, or $R^2$ and $R^3$ or $R^4$ and $R^5$ can be taken together with the carbon atom of the ring to which they are attached to form a cycloalkyl or cycloalkenyl having from 4 to 10 carbon atoms.

11. The photothermographic element of claim 10 wherein the reducing agent is a sulfonamidophenol.

12. The photothermographic element of claim 10 wherein the organic silver salt oxidizing agent is a silver salt of a fatty acid.

13. The photothermographic element of claim 10 wherein the nitroxyl bleaching agent has the formula:

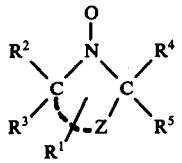

wherein Z comprises the nonmetallic atoms necessary to complete a 5 or 6 member heterocyclic ring; $R^2$, $R^3$, $R^4$ and $R^5$ are independently selected from the group consisting of alkyl, cycloalkyl, aralkyl, aryl, or $R^2$ and $R^3$ or $R^4$ and $R^5$ can be taken together with the carbon atom of the ring to which they are attached to form a cycloalkyl or cycloalkenyl having from 4 to 10 carbon atoms; and $R^1$ is selected from the group consisting of alkyl, amino, cycloalkyl, hydroxy, hydroxyimino, imino, isothiocyanato, oxo and a 5 to 10 member heterocyclic ring.

14. The photothermographic element of claim 13 wherein the nitroxyl bleaching agent has the formula:

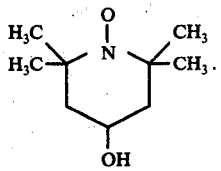

15. The photothermographic element of claim 10 which further comprises at least one binder.

16. The photothermographic element of claim 10 which further comprises at least one color-forming coupler.

17. The photothermographic element of claim 10 wherein the silver halide is silver bromoiodide.

18. The photothermographic element of claim 10 wherein the silver (I) ion complexing agent has the formula:

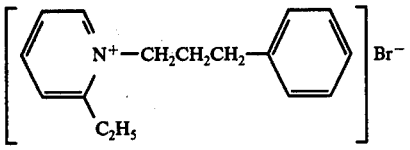

19. A photothermographic element comprising a support having thereon a layer comprising:

a. a sulfonamidophenol reducing agent;

b. a silver behenate-behenic acid dispersion;

c. silver bromoiodide;

d. a poly(vinyl butyral) binder; and e. at least one color-forming coupler; and another layer comprising a silver (I) ion complexing agent having the formula:

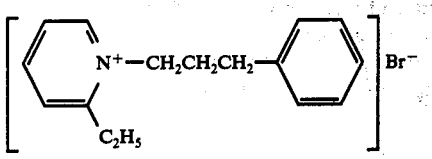

and in the same or a different layer, a stable free radical nitroxyl bleaching agent having the formula:

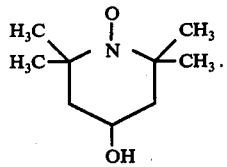

20. In a process for producing a photographic image comprising the steps of:

(1) exposure of a photothermographic element to light, said element comprising a support having thereon a layer comprising a reducing agent which provides a developed image within about 90 seconds at a temperature of about 100° to 250° C. upon heating said element, an organic silver salt oxidizing agent, and a silver halide; and (2) thermal development at a temperature above about 80° C., the improvement comprising incorporation into the photothermographic element, of a free radical nitroxyl bleaching agent having a formula selected from the group consisting:

I.

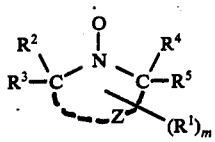

and

II.

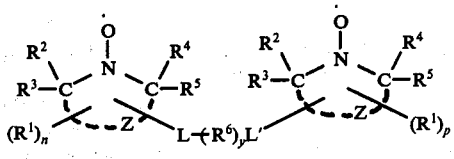

wherein Z comprises the nonmetallic atoms necessary to complete a 5 to 7 member heterocyclic ring; $y$ is 0 or 1; $m$, $n$ and $p$ are independently selected from the group of integers of 1 to 4, $R^1$ is independently selected from the group consisting of hydrogen, alkyl, amino, aryl, cycloalkyl, hydroxy, hydroxyimino, imino, isothiocyanato, oxo, a 5 to 10 member nonmetallic heterocyclic ring, a complexing ligand for silver (I) ion wherein the Ksp of the complexed product of the ligand and silver (I) ion is less than about $10^{-12}$ at 25° C., and —L—$R^9$; L and L′ are the same or different and are linking groups selected from the group consisting of amino, carbonamido, ureylene, thioureylene, oxymethylenecarbonamido, carbonyloxy, carbonyldioxy, oxycarbonyl, carbonyl, sulfonamido, amidothiocarbonyl, oxymethyleneoxycarbonyl and dicarbonamido; $R^9$ is selected from the group consisting of hydrogen, alkyl, aryl, alkenyl, aryloxy, hydroxy, amino, a cation of a quaternary ammonium salt and a 5 to 10 member nonmetallic heterocyclic ring; and $R^6$ is selected from the group consisting of alkylene, cycloalkylene, arylene, a 5 to 7 member bivalent nitrogen-containing heterocycle, and a thio-interrupted alkylene chain; and $R^2$, $R^3$, $R^4$ and $R^5$ are independently selected from the group consisting of alkyl, cycloalkyl, aralkyl, aryl, or $R^2$ and $R^3$ or $R^4$ and $R^5$ can be taken together with the carbon atom of the ring to which they are attached to form a cycloalkyl or cycloalkenyl having from 4 to 10 carbon atoms.

* * * * *